US008128517B2

(12) United States Patent
Blair

(10) Patent No.: US 8,128,517 B2
(45) Date of Patent: Mar. 6, 2012

(54) BASKETBALL COACHING SYSTEM

(76) Inventor: Warner T. Blair, Fort Worth, TX (US)

( * ) Notice: Subject to any disclaimer, the term of this patent is extended or adjusted under 35 U.S.C. 154(b) by 104 days.

(21) Appl. No.: 12/607,873

(22) Filed: Oct. 28, 2009

(65) Prior Publication Data

US 2010/0113189 A1 May 6, 2010

Related U.S. Application Data

(60) Provisional application No. 61/197,530, filed on Oct. 28, 2008.

(51) Int. Cl.
*A63B 69/00* (2006.01)

(52) U.S. Cl. ..... 473/433

(58) Field of Classification Search ..... 473/489, 473/483, 479, 447, 436, 431, 433, 422
See application file for complete search history.

(56) References Cited

U.S. PATENT DOCUMENTS

| | | | | | |
|---|---|---|---|---|---|
| 4,579,340 | A * | 4/1986 | Jenkins et al. | 473/436 |
| 4,714,248 | A * | 12/1987 | Koss | 473/436 |
| 5,039,977 | A * | 8/1991 | Mele et al. | 340/323 R |
| 5,487,540 | A * | 1/1996 | Bixler et al. | 473/436 |
| 5,681,230 | A * | 10/1997 | Krings | 473/433 |
| 5,776,018 | A * | 7/1998 | Simpson et al. | 473/433 |
| 6,224,503 | B1 * | 5/2001 | Joseph | 473/422 |
| 6,811,500 | B2 * | 11/2004 | Tien | 473/433 |
| 6,918,591 | B2 * | 7/2005 | D'Amico et al. | 473/433 |
| 7,247,105 | B2 * | 7/2007 | Huntsberger | 473/433 |
| 7,744,482 | B1 * | 6/2010 | Watson | 473/221 |
| 2010/0261557 | A1 * | 10/2010 | Joseph et al. | 473/433 |

* cited by examiner

*Primary Examiner* — Gene Kim
*Assistant Examiner* — M Chambers

(57) ABSTRACT

The present disclosure generally provides an integrated basketball return, coaching, and training system. In one embodiment, the present disclosure aids in, for example, returning basketballs to the players accurately in any position on the court, announcing scoring results, providing coaching tips and feedback information, and providing an efficient system for maximizing practice times for each player.

19 Claims, 23 Drawing Sheets

BASKETBALL COACHING SYSTEM

CROSS REFERENCE TO RELATED APPLICATION

This application claims benefit under 35 U.S.C. §119(e) of U.S. Provisional Patent Application Ser. No. 61/197,530 filed on Oct. 28, 2008 in the United States Patent and Trademark Office entitled "Basketball Return and Coaching Device." The entire disclosure of U.S. Provisional Patent Application Ser. No. 61/197,530 is incorporated by reference as if fully disclosed herein.

The present disclosure relates generally to sports training systems and in particular to systems and methods of coaching and training basketball players.

BACKGROUND

Conventional basketball training devices typically include a connection to the backboard, post, rim or the rim bracket of a basketball goal and direct the basketball to bounce in a general direction away from the goal towards the shooter. Other conventional devices use ramps or funnels of various lengths and shapes to direct the ball in a stationary direction, but do not record and analyze the shots made by the player. In addition, conventional basketball training devices are bulky, heavy, and not easily transportable by the user to and from a basketball facility. Often times, such devices require the use of tools and ladders for proper installation.

SUMMARY

Embodiments of the present disclosure generally provide portable integrated basketball return, coaching, and training system.

In one embodiment, the present disclosure could provide a training system. The system could include an elongated return apparatus having a distal end associated with a goal and a proximate end to direct a ball passing through the goal to a ball thrower. The system could also include a motorized apparatus secured to the proximate end of the return apparatus. The motorized apparatus could position the return apparatus according to a signal associated with the ball thrower.

In one embodiment, the present disclosure could provide a training system. The system could include an elongated return apparatus having a distal end associated with a goal and a proximate end to direct a ball passing through the goal to a ball thrower. The system could also include a transmitter to send a signal having information related to the position of the ball thrower to a motorized apparatus. The motorized apparatus could position the return apparatus to direct the ball to the ball thrower based on the signal.

In one embodiment, the present disclosure could provide a training system. The system could include an elongated return apparatus having a distal end associated with a goal and a proximate end to direct a ball passing through the goal to a ball thrower. The system could include a support structure having a power source on one end and a motorized apparatus on the other end. The motorized apparatus could be secured to the proximate end of the return apparatus. The system could further include a transmitter to generate a signal having information related to the position of the ball thrower. The motorized apparatus positions the return apparatus based on the signal. The system could still further include a circuit to correlate statistics based on the number of goals achieved by the ball thrower.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The present disclosure generally provides a portable integrated basketball return, coaching, and training system. In one embodiment, the present disclosure aids in, for example, returning basketballs to the players accurately in any position on the court, announcing scoring results, providing coaching tips and feedback information, and providing an efficient system for maximizing practice times for each player. It should be understood that embodiments of the present disclosure could be used in conjunction with a single player or on multiple players at any given time.

Figure 1:
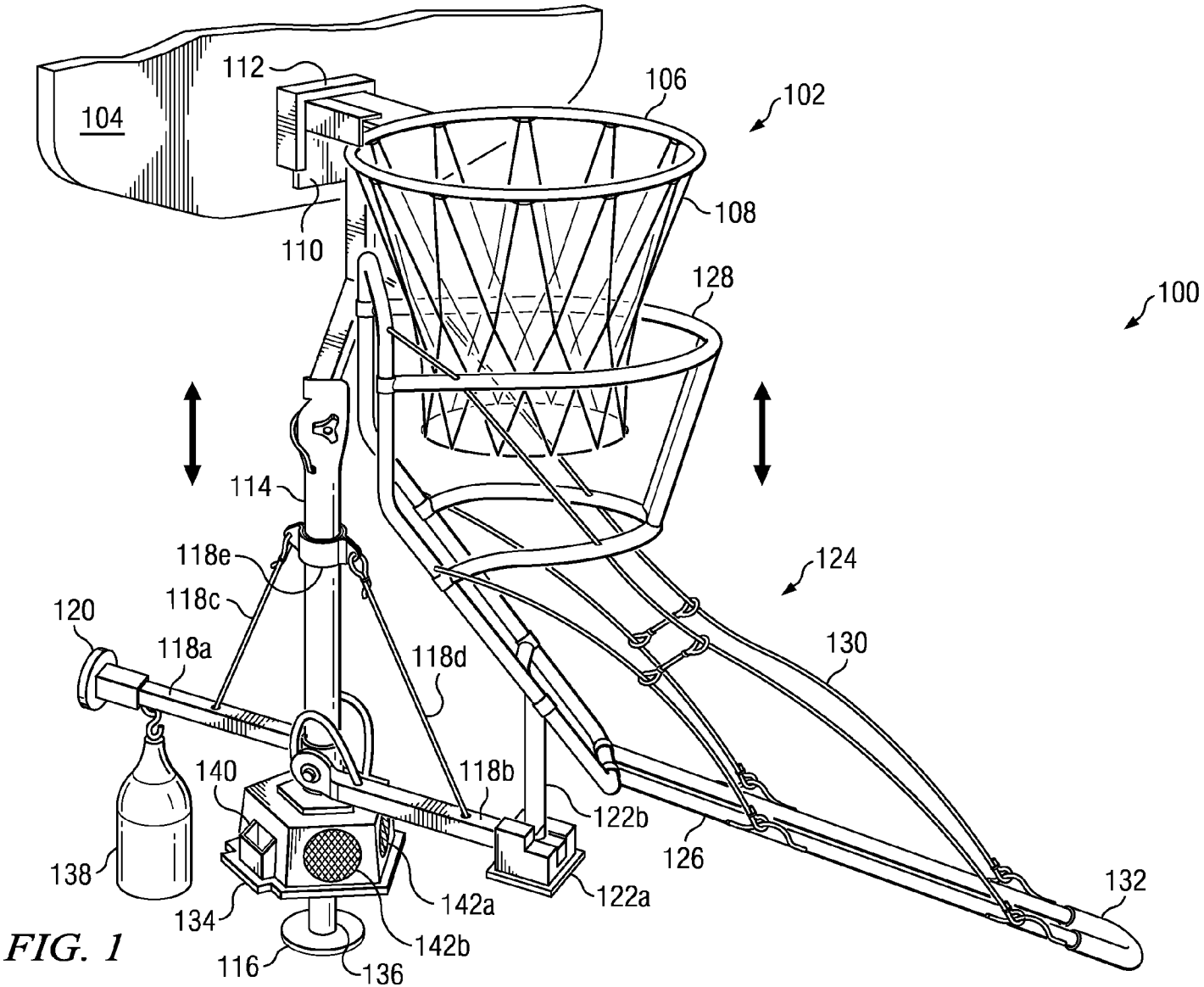
FIG. 1 is a perspective view of a basketball return and coaching system according to one embodiment of the present disclosure.
Figure 29:
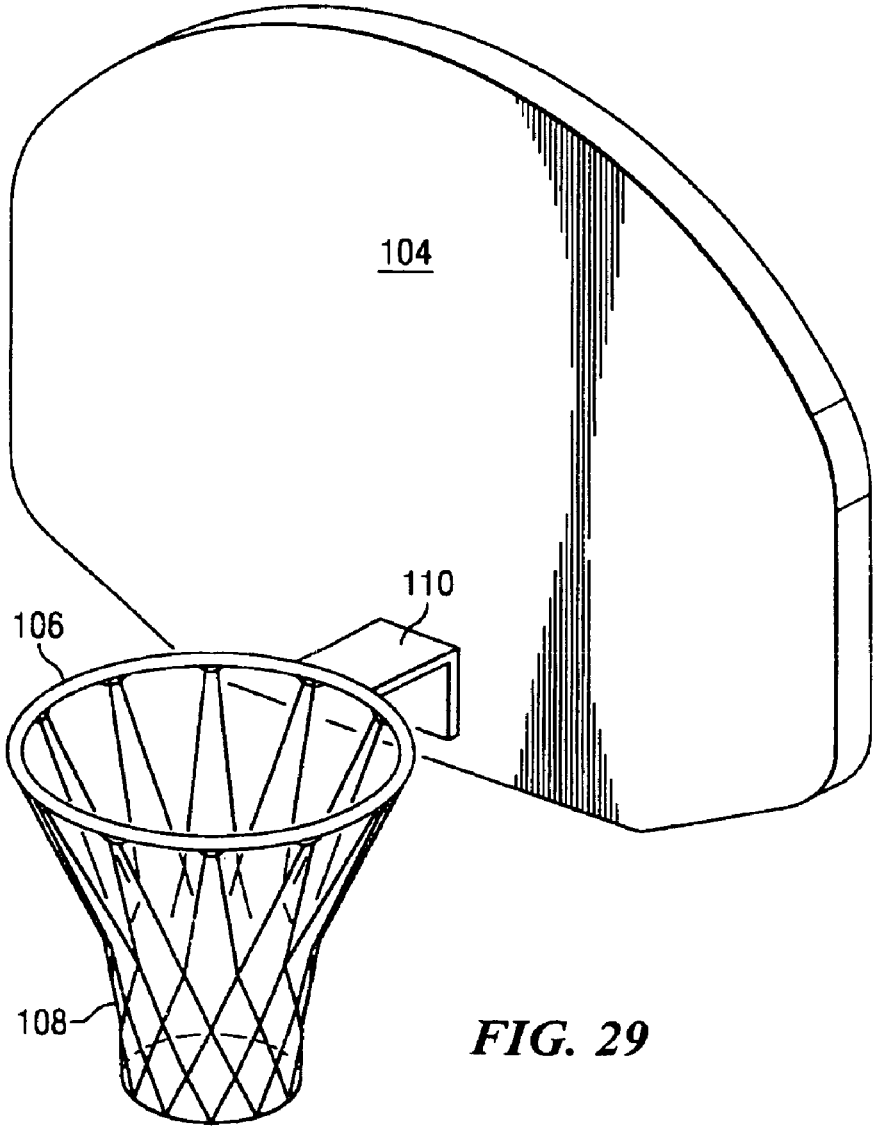
FIG. 29 is a perspective view of a typical basketball goal according to one embodiment of the present disclosure.

FIG. 1 is a perspective view of a portable basketball return and coaching system 100 according to one embodiment of the present disclosure relative to basketball goal 102. It should be understood that system 100 and goal 102 shown in FIG. 1 is for illustrative purposes only and that any other suitable system or subsystem could be used in conjunction with or in lieu of system 100 or goal 102 according to one embodiment of the present disclosure. In addition, FIG. 29 provides another illustration of basketball goal 102 according to one embodiment of the present disclosure.

System 100 could be made of any suitable material or combination of materials and be used in conjunction with any conventional basketball goal 102 including those having, for example, backboard 104, rim 106, net 108, and rim bracket 110 as generally shown in FIG. 1. It should be understood, however, that system 100 could also be used in any other suitable basketball goals, basketball hoops, goals, baskets, other suitable sporting related devices, or any combination thereof. System 100 could be configured to collapse and fold into a unit that is relatively easy to handle, store, transport, install, adjust, un-install, and remove according to one embodiment of the present disclosure.

In one embodiment, system 100 could generally include anchoring system 112, extension structure 114, stand system 116, supports 118*a*, 118*b*, 118*c*, 118*d*, and 118*e*, power supply 120, rotation module 122*a*, support 122*b*, and return device 124 according to one embodiment of the present disclosure. Return device 124 could include, for example, elongated deflector 126, capture structures 128 and 130, and bumper 132. In addition, system 100 could include housing 134, handle 136, weight 138, music input 140, and speakers 142*a* and 142*b*.

Anchoring system 112 could be made of any suitable material or combination of materials and generally aids in anchoring, retaining, securing, or otherwise disposing system 100 to basketball goal 102. When in position, anchoring system 112 could support system 100 and aid in maintaining a somewhat vertical position of system 100 that is generally perpendicular to the ground. Anchoring system 112 could include a generally hook-shaped clamping mechanism secured to one end of extension structure 114. Anchoring system 112 could be configured to clamp or otherwise secure to rim bracket 110 and thus provide a secure connection to basketball goal 102. In one embodiment, anchoring system 112 could be lined with or otherwise include foam, memory foam, temporary adhesive, tape, rubber, silicone, other formable or configurable material, or any combination thereof that could conform with, secure or adhere to, or protect the finish of rim bracket 110 according to one embodiment of the present disclosure.

Extension structure 114 could be made of any suitable material or combination of materials and configured to generally extend the length of support structure 102. In one embodiment, extension structure 114 could include a hollow structure, telescoping structure, retractable structure, sliding structure, folding structure, other extendible structure, or any combination thereof that is capable of extending the overall length of support structure 102. Extension structure 114 could allow someone using system 100 to install system 100 from the ground without the use of any ladders or other similar devices according to one embodiment of the present disclosure.

System 100 and in particular extendible structure 114 could be made of a relatively cheap, light-weight, and durable material according to one embodiment of the present disclosure. In one embodiment, system 100 and in particular extendible structure 114 could be a hollow structure to accommodate any necessary wiring to connect to different components of system 100. For example, the use of standard PVC pipe material or similar materials would be cost effective, light-weight, durable, and structurally advantageous while keeping manufacturing cost down.

Stand system 116 could be made of any suitable material or combination of materials and is generally configured to help anchor, support, or maintain the position of system 100 relative to basketball goal 102. Stand system 116 could be configured to fit or otherwise secure to one end of support structure 102 as shown in FIG. 1.

System 100 could be designed to freely hang from basketball goal 102 and therefore stand system 116 need not necessarily include any contact with the ground according to one embodiment of the present disclosure. Thus, system 100 could absorb impacts from balls hitting it when in use. However, in one embodiment, stand system 116 could include a rubberized or otherwise treated surface to aid in maintaining a relatively tight grip between it and the surface of the ground and reducing any movement of system 100.

Supports 118*a*, 118*b*, 118*c*, 118*d*, and 118*e* could be made of any suitable material or combination of materials. Support 118*a* could pivotally coupled or otherwise secured to extension structure 114 and supports motor 120 as shown in FIG. 1. Support 118*b* could also pivotally coupled or otherwise secured to extension structure 114 and supports rotation module 122. Support 118*c* could be pivotally coupled to or generally aid in positioning support 118*a* as shown in FIG. 1. Support 118*d* could be pivotally coupled to or generally aid in positioning support 118*b* as shown in FIG. 1. In one embodiment, supports 118*c* and 118*d* could include a rope, string, other flexible or collapsible material, or any combination thereof. Support 118*e* could secure or otherwise retain 118*c* and 118*d* in position relative to extension structure 114 according to one embodiment of the present disclosure.

Power supply 120 could be any suitable power source. In one embodiment, power supply 120 could include one or more of a battery, rechargeable battery, DC power supply, AC power supply, solar power supply, kinetic power supply, wind power supply, detachable power supply, other suitable power supplies, or any combination thereof. Power supply 120 could supply power to, for example, system 100 or to select parts of system 100.

In one embodiment, power supply 120 could act as a ballast to offset the weight of system 100 and, in particular, rotation module 122*a*. In another embodiment, a battery interface could be removably connected with battery latches for a more secure connection between components of system 100. In one embodiment, a battery or power source recharger could be incorporated into system 100 and could eliminate the need for removing the batteries for re-charging.

Rotation module 122*a* and support 122*b* could be made of any suitable material or combination of materials and include any simple motor, stepper motor, DC motor, other suitable drive mechanism, or any combination thereof. In one embodiment, rotation module 122*a* could be secured to return device 124 by support 122*b* as shown in FIG. 1. In one embodiment, rotation module 122*a* could drive support 122*b* which, in turn, could change the position of return device 124 as described in more detail later herein. It should be understood, however, that rotation module 122*a* could be secured to return device 124 by any other suitable method or combination of methods.

Return device 124, elongated deflector 126, and capture structures 128 and 130 could be made of any suitable material or combination of materials. Return device 124 could be made of vacuum or injection molded materials as two separate parts hinged together or a single part molded with the hinge area thinned out to allow folding at that point according to one embodiment of the present disclosure.

In one embodiment, return device 124 could use elongated deflector 126, and capture structures 128 and 130 to direct a ball thrown to basketball goal 102 back to the shooter. For example, when the ball is thrown to basketball goal 102 and the ball travels past rim 106 and net 108, capture structures 128 and 130 to direct the ball to elongated deflector 126. Elongated deflector 126 could include at least two inline track-like structures for directing a ball back to the shooter after making a goal according to one embodiment of present disclosure.

In one embodiment, return device 124 could be mounted or otherwise secured to system 100 by a connection point on the underside of return device 124. For example, instead of a distal end of mounting return device 124 to basketball goal 102, rim 106, or rim bracket 110, return device 124 could be mounted using a proximate end of return device 124 as shown in FIG. 1. Thus, the proximate end of return device 124 is configurable to rotate about a vertical axis and face the shooter as he/she moves about the basketball court, substantially perpendicular to the floor without interfering with any hardware or portion of basketball goal 102 according to one embodiment of the present disclosure.

It should be understood that return device 124 could be configured to rotate about a vertical axis a full 180 degrees or any other suitable rotational capability including, for example, any suitable rotation in which return device 124 could face the extreme left or right of basketball goal 102.

Bumper 132 could be made of any suitable material or combination of materials. In one embodiment, bumper 132 could be made of or formed with foam, memory foam, rubber, silicon, other formable or configurable material. Bumper 132 could be generally U-shaped as shown in FIG. 1 or include a handle-like structure that is ergonomically shaped for ease of handling according to one embodiment of the present disclosure.

Housing 134 could be made of any suitable material or combination of materials. Housing 134 could be secured to extension structure 114 at a proximate end and to handle 136 at a distal end as shown in FIG. 1. Housing 134 could generally house various electrical and electronic components of system 100 such as, for example, speakers, electronic circuitry, sensing system, control system, and other components as later described in detail herein.

Handle 136 could be made of any suitable material or combination of materials. In one embodiment, handle 136 could be secured to housing 143 at a proximate end and to stand system 116 at a distal end as shown in FIG. 1. Handle 136 could include a pin and lever system for adjusting the length of system 100 as well as the relative height of stand system 116. Handle 136 could be lined with or otherwise include foam, memory foam, temporary adhesive, tape, rubber, silicone, other formable or configurable material, or any combination according to one embodiment of the present disclosure.

Weight 138 could include any suitable item or materials used to aid in balancing system 100. For example, weight 138 could be used to support and balance supports 118*a* and 118*b* according to one embodiment of the present disclosure. In one embodiment, weight 138 could, for example, include a water bottle as shown in FIG. 1 or any other suitable item or weighted material.

Music input 140 could include any suitable connection or combination of connections for an MP3 player, music player, tape recorder, CD player, visual input, audio input, computer input, phone, cellular phone, PDA, pocket computer, GPS device, recording device, Internet connection, light source, scanning device, sensing device, other suitable input, or combination thereof. In one embodiment, music input 140 could draw power from power supply 120.

Speakers 142*a* and 142*b* could be housed in housing 134 and include any suitable audio output device. Although FIG. 1 illustrates two speakers 142*a* and 142*b*, it should be understood that system 100 could include no speakers at all, one speaker, or any suitable number of speakers according to one embodiment of the present disclosure.

It should also be understood that system 100 could include additional features not described in full herein. For example, in one embodiment, system 100 could include using a video, webcam, sensor, or other imaging or sensing device (not shown) to capture images or movements of the shooter, ball, basketball goal 102, parts of basketball goal 102, system 100, parts of system 100, other suitable item, or any combination thereof. In addition, it should be understood that system 100 could be used in conjunction with one shooter, two shooters, or any number of shooters at any given time so that the shooters could practice shooting in a generally round-robin fashion.

Any images, information, recordings, or other data collected by system 100 could be viewed in real-time or stored for later viewing and analysis. The analysis could include comparing different movements against ideal or desired movement and providing an analysis of the comparison. In doing so, system 100 could provide corrective actions, coaching tips, shooter feedback, comparison images, statistics, suggested practice drills or shots, training information, other suitable actions, or any combination thereof.

In addition, it should be understood that a USB port or any other suitable input/output connection could also be included in system 100 to enable the downloading (or uploading) of information to and from system 100 and a computer, PDA, disk, storage drive, other suitable media, or any combination thereof. System 100 could also include other input/output devices such as, for example, printers, printer heads, scanners, alarms, LCD panels, video displays, audio inputs, audio outputs, other devices, or any combination thereof according to one embodiment of the present disclosure.

Figure 2:
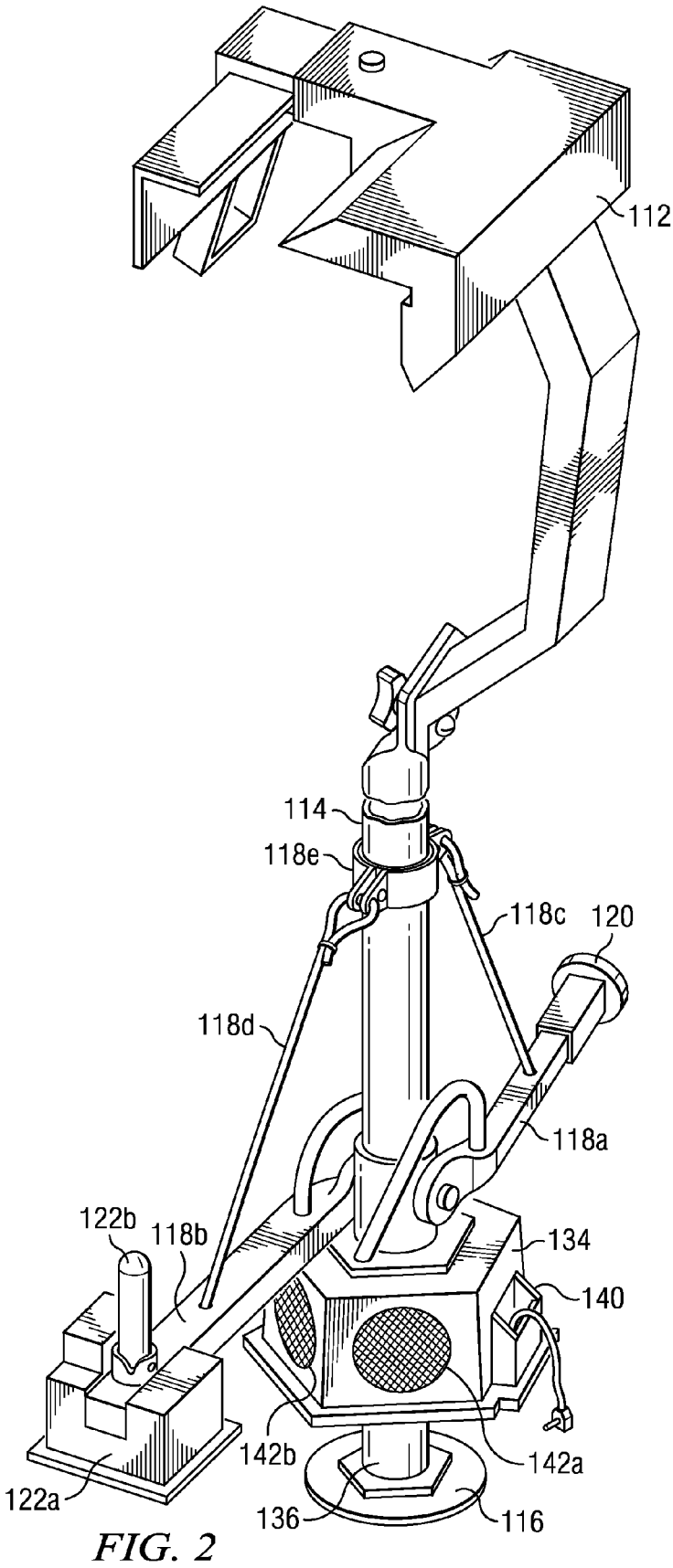
FIG. 2 is a perspective view of the support structure system according to one embodiment of the present disclosure.

FIG. 2 is another perspective view of the system 100 according to one embodiment of the present disclosure. It should be understood that system 100 shown in FIG. 2 is for illustrative purposes only and that any other suitable system or subsystem could be used in conjunction with or in lieu of system 100 according to one embodiment of the present disclosure. The elements shown in FIG. 2 are generally depicted in FIG. 1 and are referred to and described in the description accompanying FIG. 1 herein.

Figure 3:
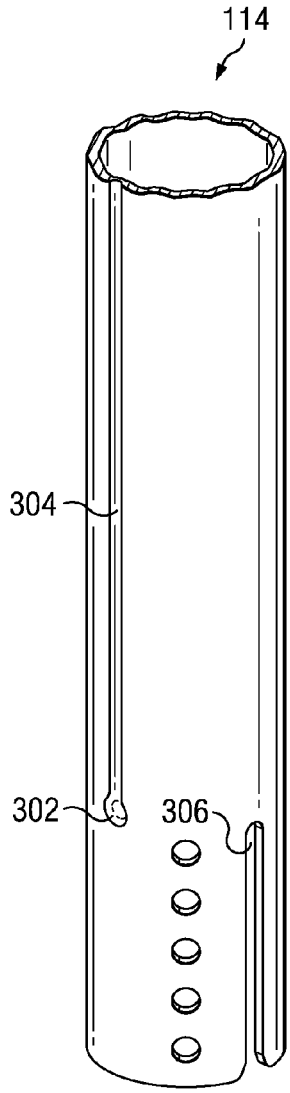
FIG. 3 is a perspective view of the elongated beam for use with the support structure system shown in FIG. 2 according to one embodiment of the present disclosure.
Figure 5:
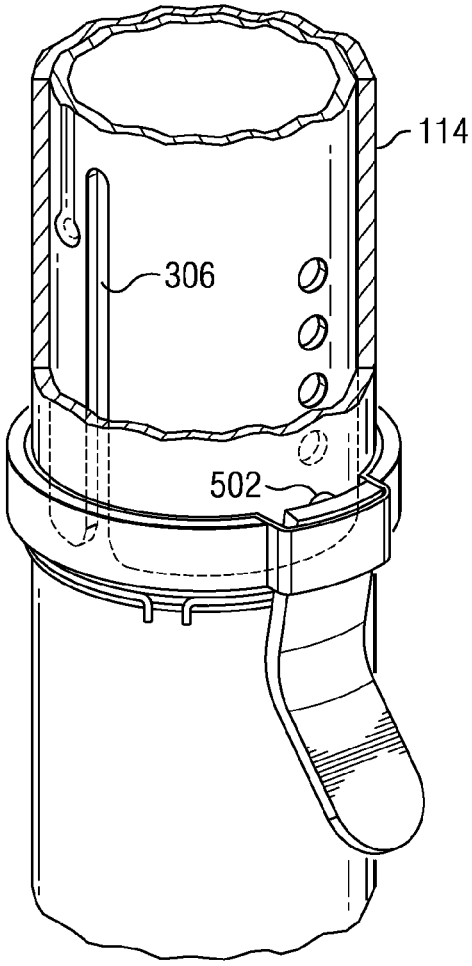
FIG. 5 is a perspective view of the adjustable pole and adjusting mechanism according to one embodiment of the present disclosure.

FIGS. 3 and 5 are perspective views of a portion of extension structure 114 used in system 100 according to one embodiment of the present disclosure. It should be understood that extension structure 114 shown in FIGS. 3 and 5 are for illustrative purposes only and that any other suitable system or subsystem could be used in conjunction with or in lieu of extension structure 114 and the components shown in FIGS. 3 and 5 according to one embodiment of the present disclosure.

Extension structure 114 shown in FIG. 3 could include catch indent 302, holes 304*a*, 304*b*, 304*c*, 304*d*, and 304*e* (collectively, referred to herein as holes 304), and groove 306 according to one embodiment of the present disclosure. Extension structure 114 could be an adjustable pole and could slide freely to a fully extended position, a fully retracted position, and other positions in-between.

In one embodiment, extension structure 114 could include a number of catch indents such as, for example, catch indent 302. As an example, extension structure 114 could slide freely to an extended position and then be positioned or otherwise secured by catch indent 302 as shown in FIG. 3. It should be understood that any number of catch indent 302 could be used according to one embodiment of the present disclosure.

Holes 304*a*, 304*b*, 304*c*, 304*d*, and 304*e* (collectively referred to herein as holes 304) could also be used to position or otherwise retain a particular disposition for extension structure 114. For example, holes 304 could be used to align with, for example, structure 502 illustrated in FIG. 5. Groove 306 shown in FIG. 3 could be a groove disposed laterally along a side of the extension structure 114 to keep extension structure 114 from rotating. It should be understood that any suitably structured mechanism to retain a particular disposition for extension structure 114 could be used in conjunction with or in lieu of holes 304, structure 502, or groove 306.

Figure 4:
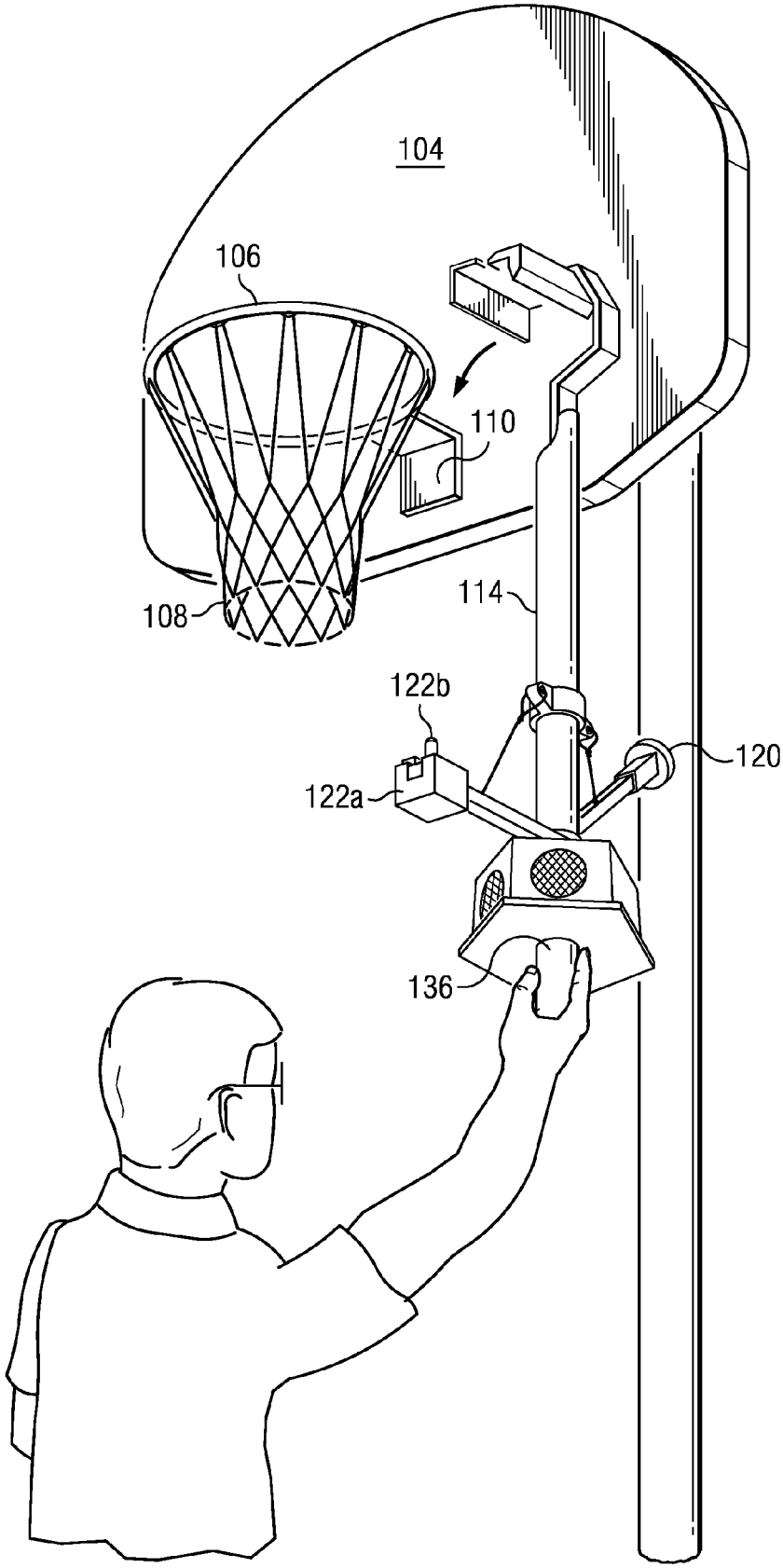
FIG. 4 is an exemplary illustration of the basketball return and coaching system shown in FIG. 1 being installed to a basketball goal rim bracket according to one embodiment of the present disclosure.

FIG. 4 is exemplary illustration of the system 100 shown in FIG. 1 being installed on to rim bracket 110 of basketball goal 102 according to one embodiment of the present disclosure. It should be understood that installation illustration shown in FIG. 4 is for illustrative purposes only and that any other suitable installation system, subsystem, method, or submethod could be used in conjunction with or in lieu of the illustration shown in FIG. 4 according to one embodiment of the present disclosure. The elements shown in FIG. 4 are generally depicted in FIG. 1 and are referred to and described in the description accompanying FIG. 1 herein.

Briefly, extendible structure 114 could be pulled out of its storage position and locked into an extended position according to one embodiment of the present disclosure. The user, while holding handle 136, hooks the anchoring system 112 over rim bracket 110 and pulls system 100 down. Anchoring system 112, in turn, slides down over rim bracket 110 and thus secures system 100 to rim bracket 110. The user could then move both support 118*a* and 118*b* to their respective operational positions and places rotation module 122*a* onto support 122*b* according to one embodiment of the present disclosure.

Figure 6:
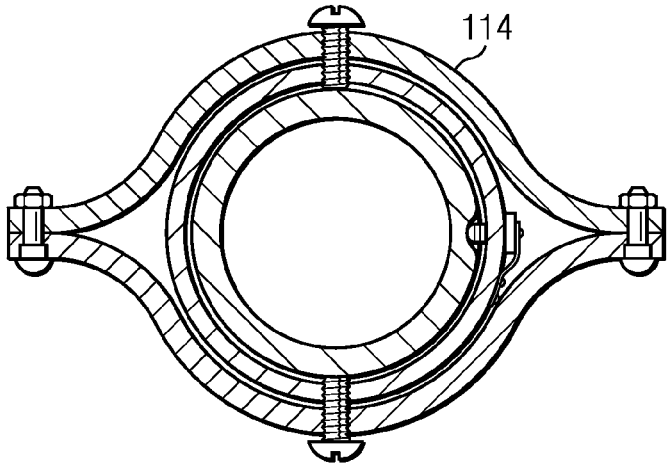
FIG. 6 is a perspective view of the cross section of adjustable pole shown in FIG. 8 according to one embodiment of the present disclosure.

FIG. 5 is generally discussed in conjunction with the description accompanying FIG. 3 above, while FIG. 6 is generally discussed in conjunction with the description accompanying FIG. 8 below.

Figure 7:
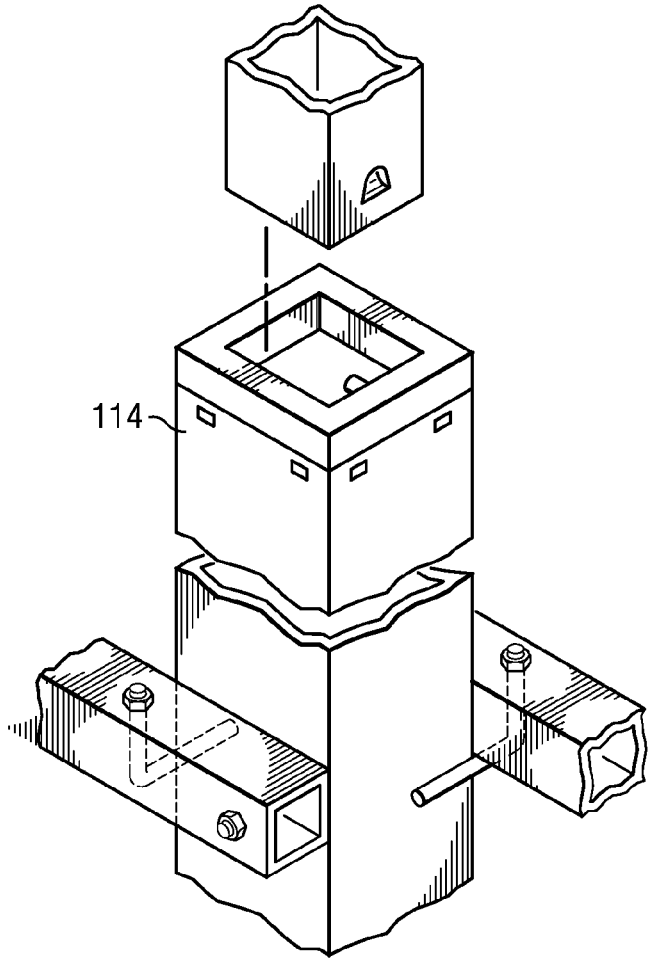
FIG. 7 is a perspective view using alternative square tubing according to one embodiment of the present disclosure.
Figure 8:
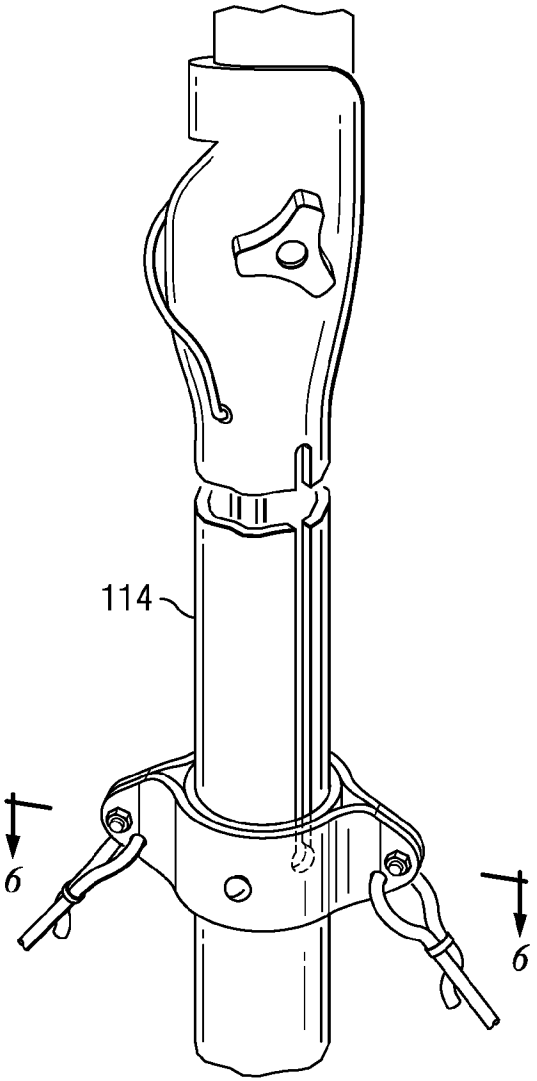
FIG. 8 is a perspective view of the adjustable pole using round tubing according to one embodiment of the present disclosure.

FIGS. 7 and 8 are perspective views of extension structure 114 having a square shaped tube structure and a round tube structure, respectively, according to one embodiment of the present disclosure. It should be understood that extension structure 114 shown in FIGS. 7 and 8 are for illustrative purposes only and that any other suitable size, shape, or configuration of extension structure 114 could be used in conjunction with or in lieu of extendible structure 114 shown in FIGS. 7 and 8 according to one embodiment of the present disclosure. The components shown in FIGS. 7 and 8 are similar to those shown in and described in conjunction with FIGS. 1, 2, and 3. FIG. 6 is an exemplary cross-sectional view of extension structure 114 shown in FIG. 8.

The square tubing shown in FIG. 7 and other similar shapes could, for example, eliminate the need for groove 304 shown in FIG. 3 along the side of extendible structure 114. In one embodiment, square metal tubing could be more acceptable in the athletic equipment field because of its relatively rugged look and feel.

FIGS. 9-11, 13, 14, 16 and 17 illustrate various views of anchoring system 112 and rim bracket 110 according to one embodiment of the present disclosure. It should be understood that anchoring system 112 shown in FIGS. 9-11, 13, 14, 16 and 17 are for illustrative purposes only and that any other suitable size, shape, or configuration of anchoring system 112 could be used in conjunction with or in lieu of anchoring system 112 shown in FIGS. 9-11, 13, 14, 16 and 17 according to one embodiment of the present disclosure.

Figure 9:
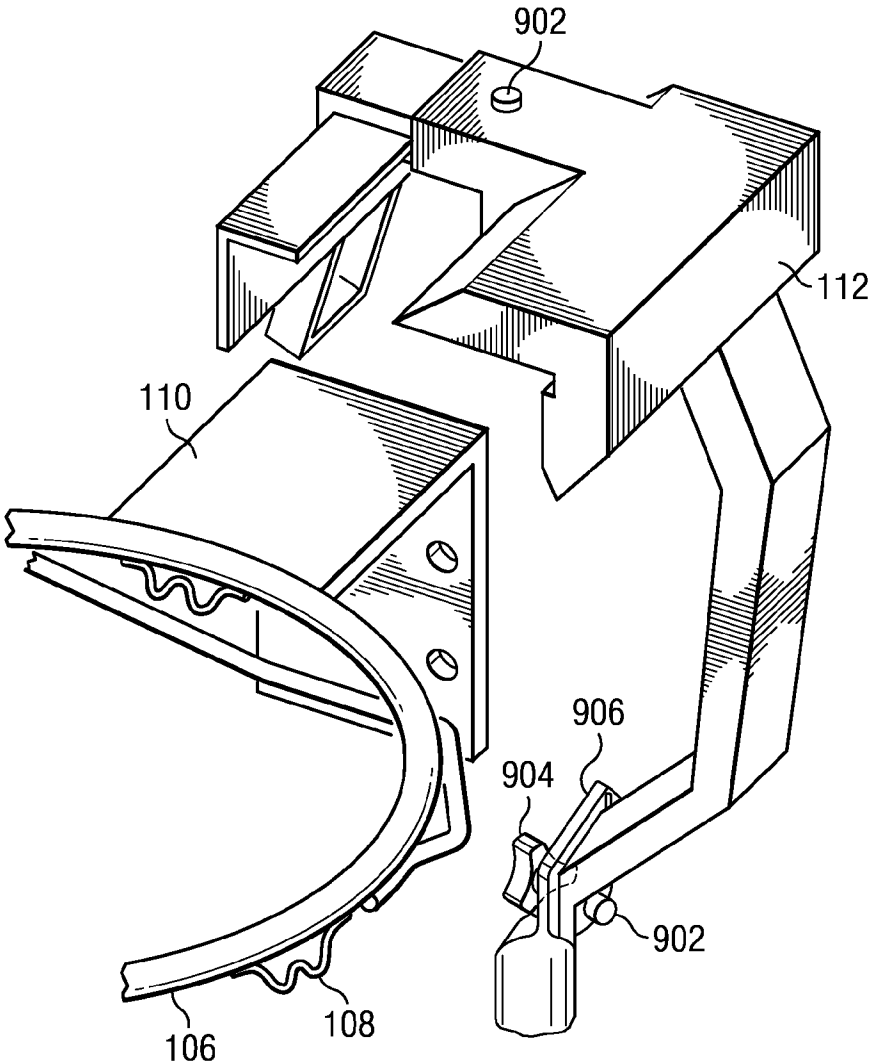
FIG. 9 is a perspective view of the attaching unit with normal basketball rim according to one embodiment of the present disclosure.
Figure 11:
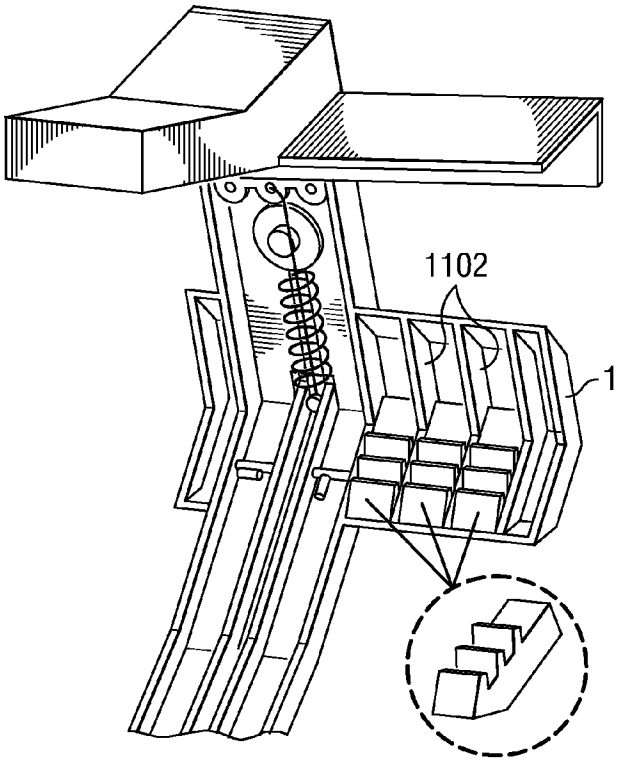
FIG. 11 is a perspective view of the attaching unit showing the clamping structure according to one embodiment of the present disclosure.
Figure 10:
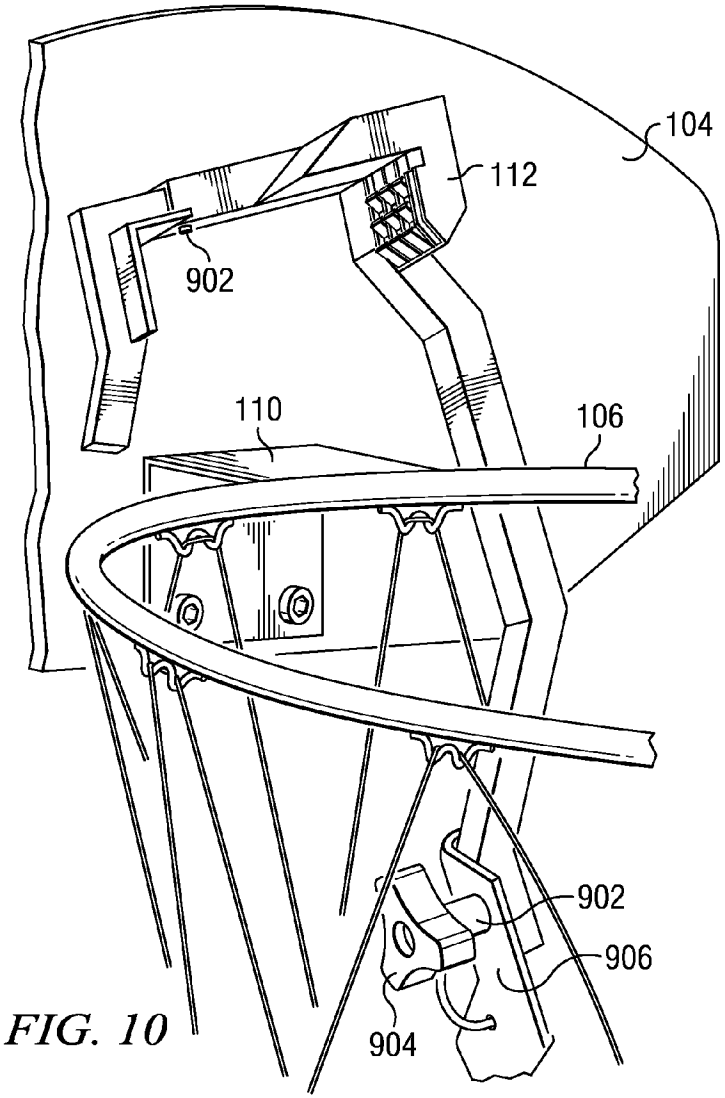
FIG. 10 is a perspective view of the attaching unit showing friction fingers according to one embodiment of the present disclosure.
Figure 13:
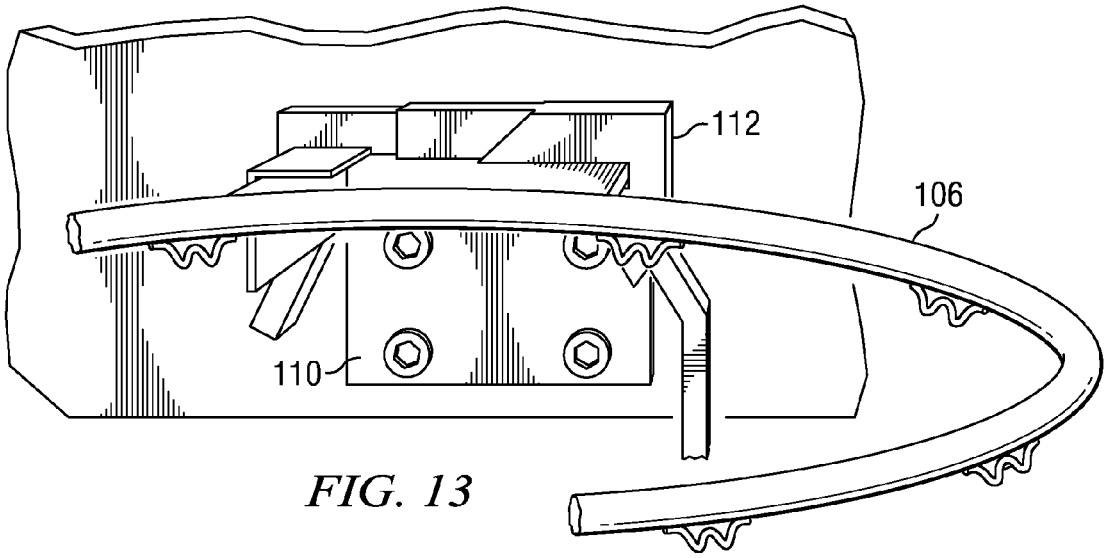
FIG. 13 is a perspective view of the attaching unit on a typical goal rim bracket according to one embodiment of the present disclosure.
Figure 14:
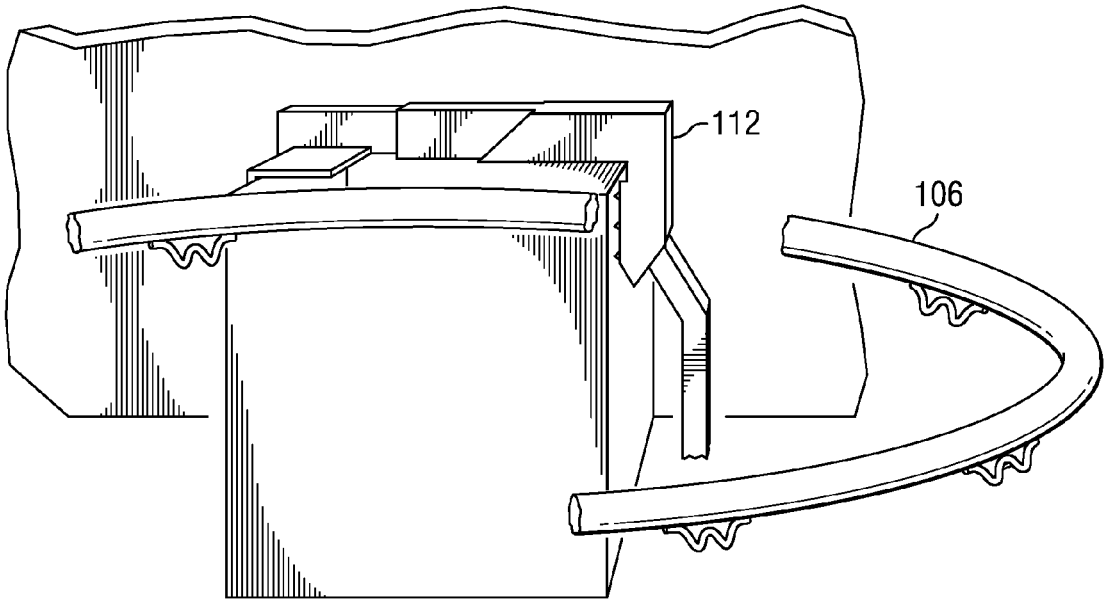
FIG. 14 is a perspective view of the attaching unit on a box-type goal rim bracket according to one embodiment of the present disclosure.

Anchoring system 112 could be secured to one end of extendible structure 114 and attached to rim bracket 110 by pin 902 and tightening knob 904 according to one embodiment of the present disclosure as generally shown in FIGS. 9-11. In one embodiment, stopping device 906 could include, for example, a pin or a protrusion molded into extendible structure 11. Stopping device 906 could be embedded on extendible structure 114 and restrict movement of anchoring system 112 in one direction when system 100 is in use according to one embodiment of the present disclosure.

In one embodiment, rubber pieces 1102 shown in FIG. 11 could include upward protruding finger-like structures disposed at approximately forty degrees from vertical plane. Rubber pieces 1102 could contact surface rim bracket 110 and friction between the surfaces could aid in resisting movement when the unit is pushed into its operative position close to the rim. Accordingly, rubber pieces 1102 could prevent system 100 and anchoring system 112 from disengaging from rim bracket 110.

Figure 12:
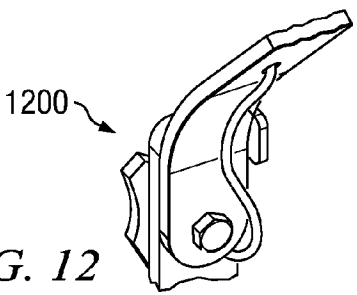
FIG. 12 is a perspective view of the transitioning of shock sensor wires according to one embodiment of the present disclosure.

FIG. 12 is a perspective view of shock sensor 1200 according to one embodiment of the present disclosure. It should be understood that shock sensor 1200 shown in FIG. 12 is for illustrative purposes only and that any other suitable size, shape, or configuration of shock sensor 1200 could be used in conjunction with or in lieu of shock sensor 1200 shown in FIG. 12 according to one embodiment of the present disclosure.

Sensor 1200 could be located or disposed about anchoring system 112 according to one embodiment of the present disclosure. In one embodiment, shock sensor 1200 could be placed as close to the rim bracket 110 as possible so as to absorb vibrations. Shock sensors 1200 could be positioned horizontally and vertically relative to system 100 to maximize their sensitivity according to one embodiment of the present disclosure. It should be understood that any number of sensors 1200 could be used in accordance with the present disclosure.

Figure 15:
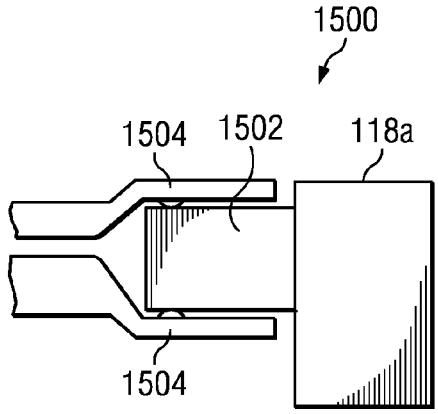
FIG. 15 is a perspective view of the battery pack connecting with the support beam according to one embodiment of the present disclosure.
Figure 16:
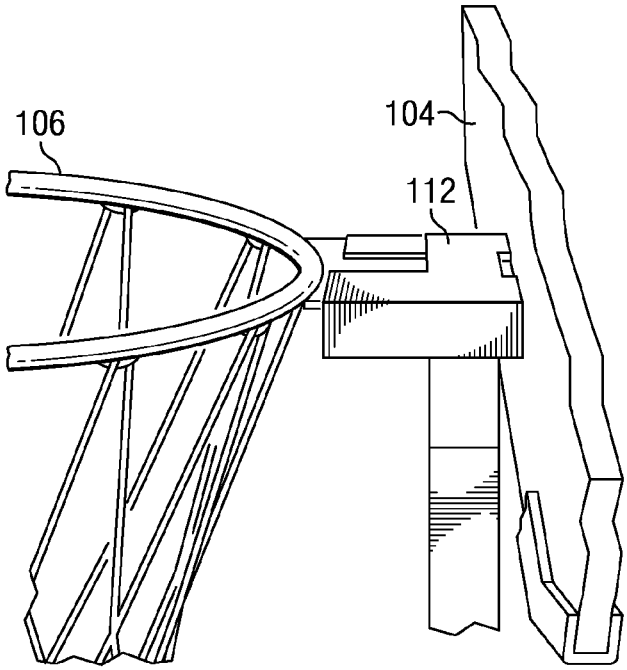
FIG. 16 is a perspective view of the backboard trim offset feature of the attaching unit according to one embodiment of the present disclosure.
Figure 17:
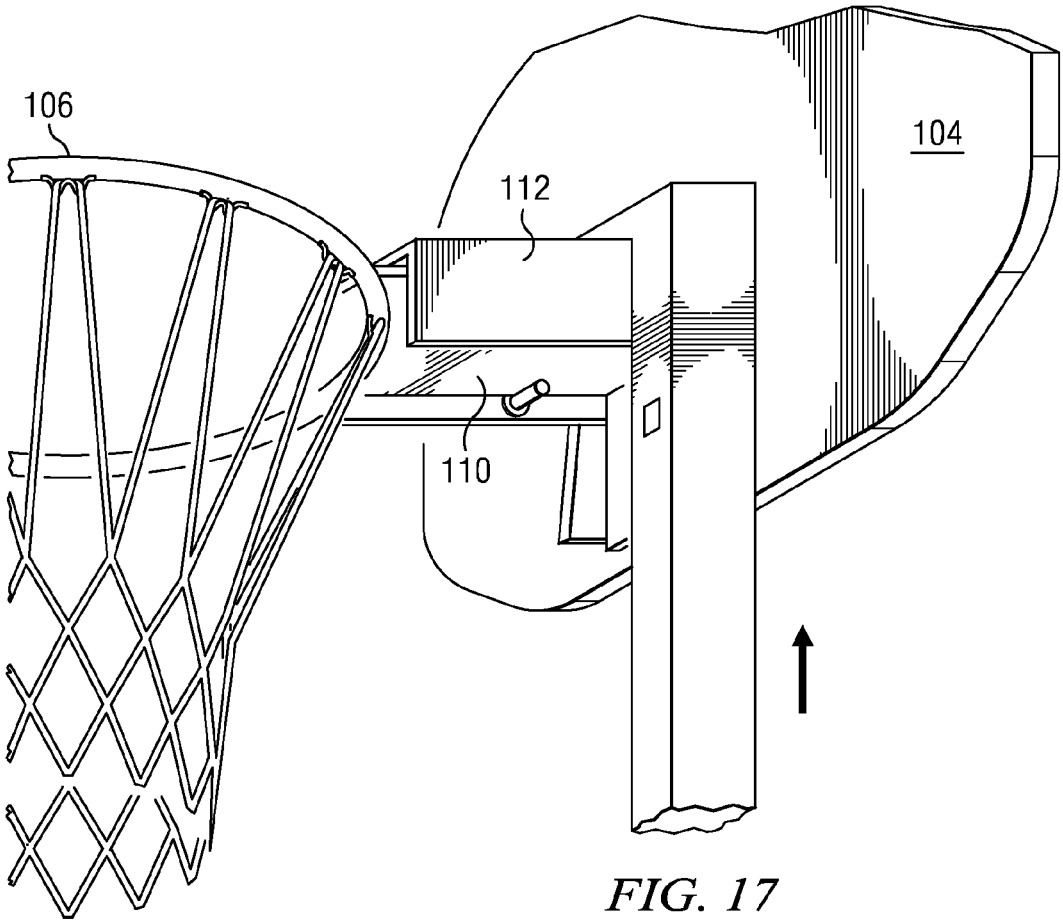
FIG. 17 is a perspective view of the attaching unit and its retractable pin according to one embodiment of the present disclosure.
Figure 18A:
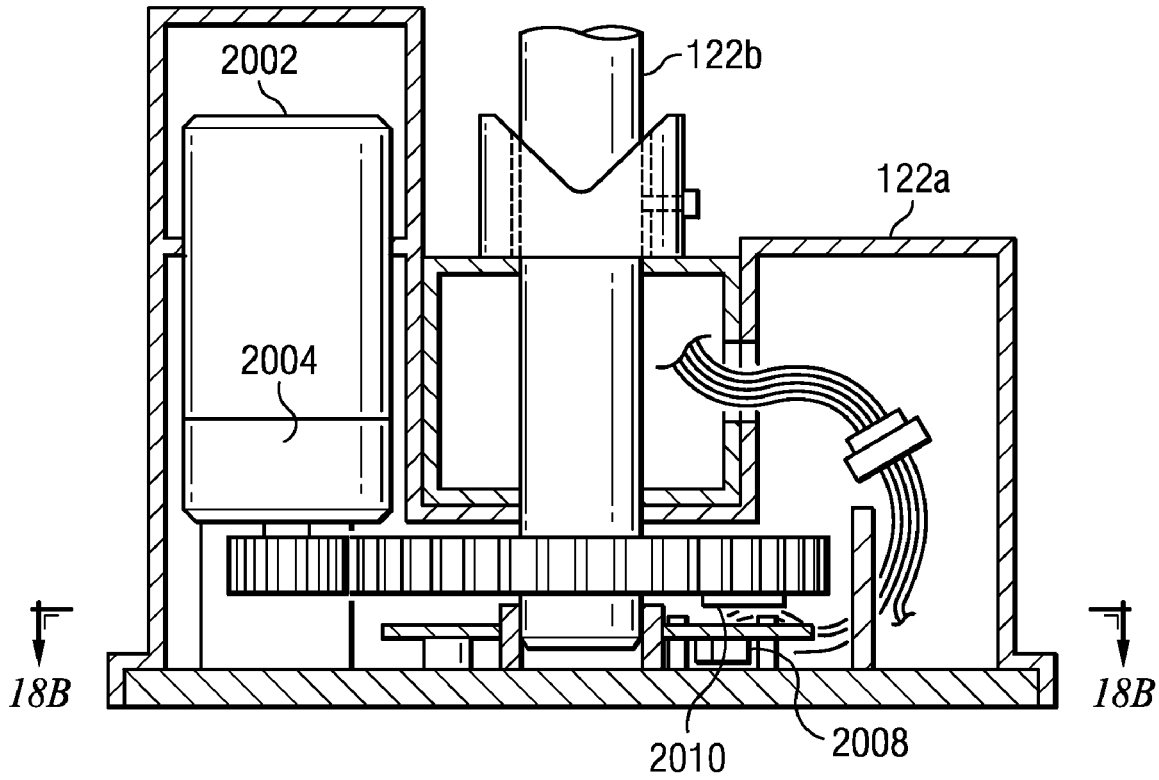
FIG. 18 is a sectional view of the turning module according to one embodiment of the present disclosure.
Figure 18B:
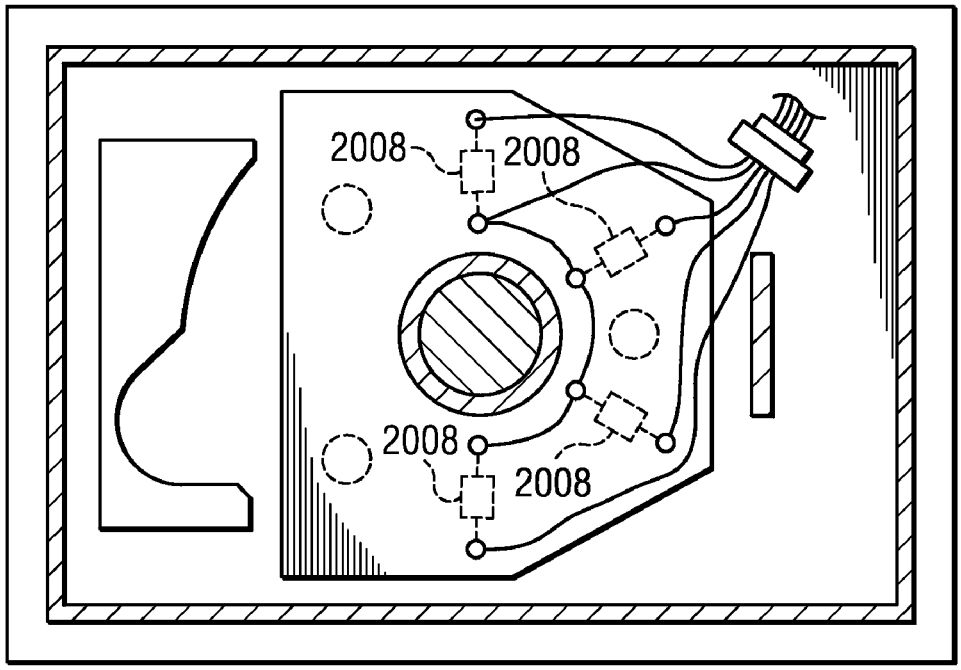
Figure 21:
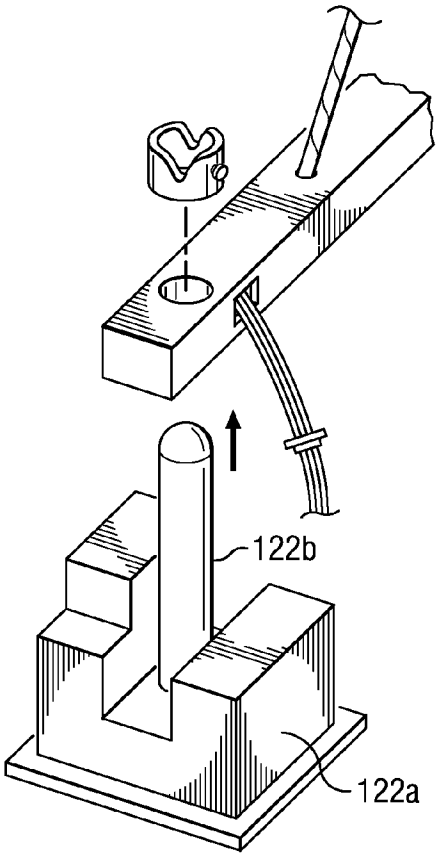
FIG. 21 is a perspective view of the turning module assembly according to one embodiment of the present disclosure.
Figure 20:
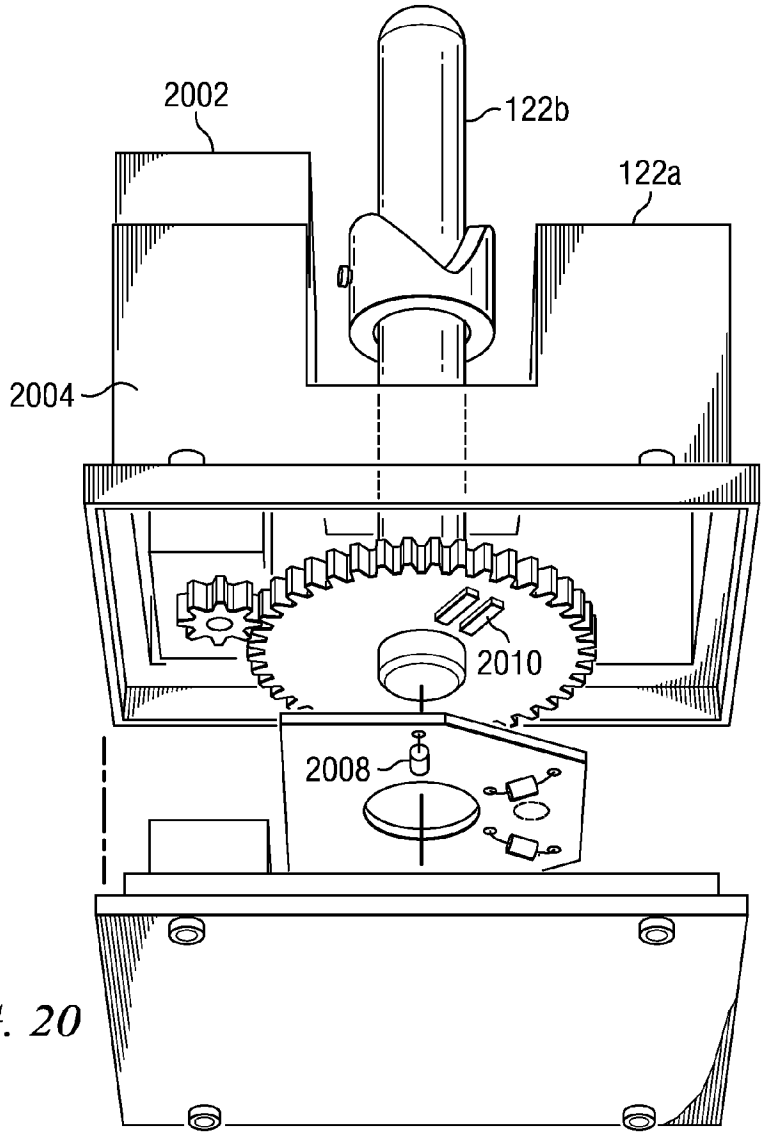
FIG. 20 is a perspective view of the turning module with internal parts exposed according to one embodiment of the present disclosure.
Figure 19:
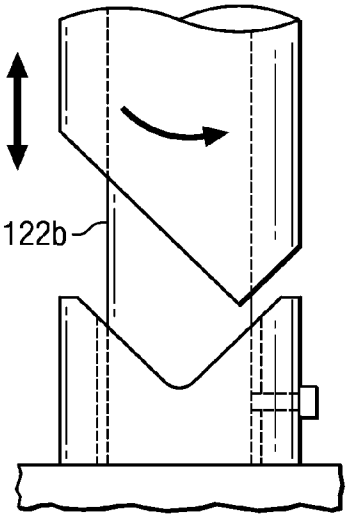
FIG. 19 is a perspective view of the turning shaft with 'V' shaped collar according to one embodiment of the present disclosure.
Figure 22:
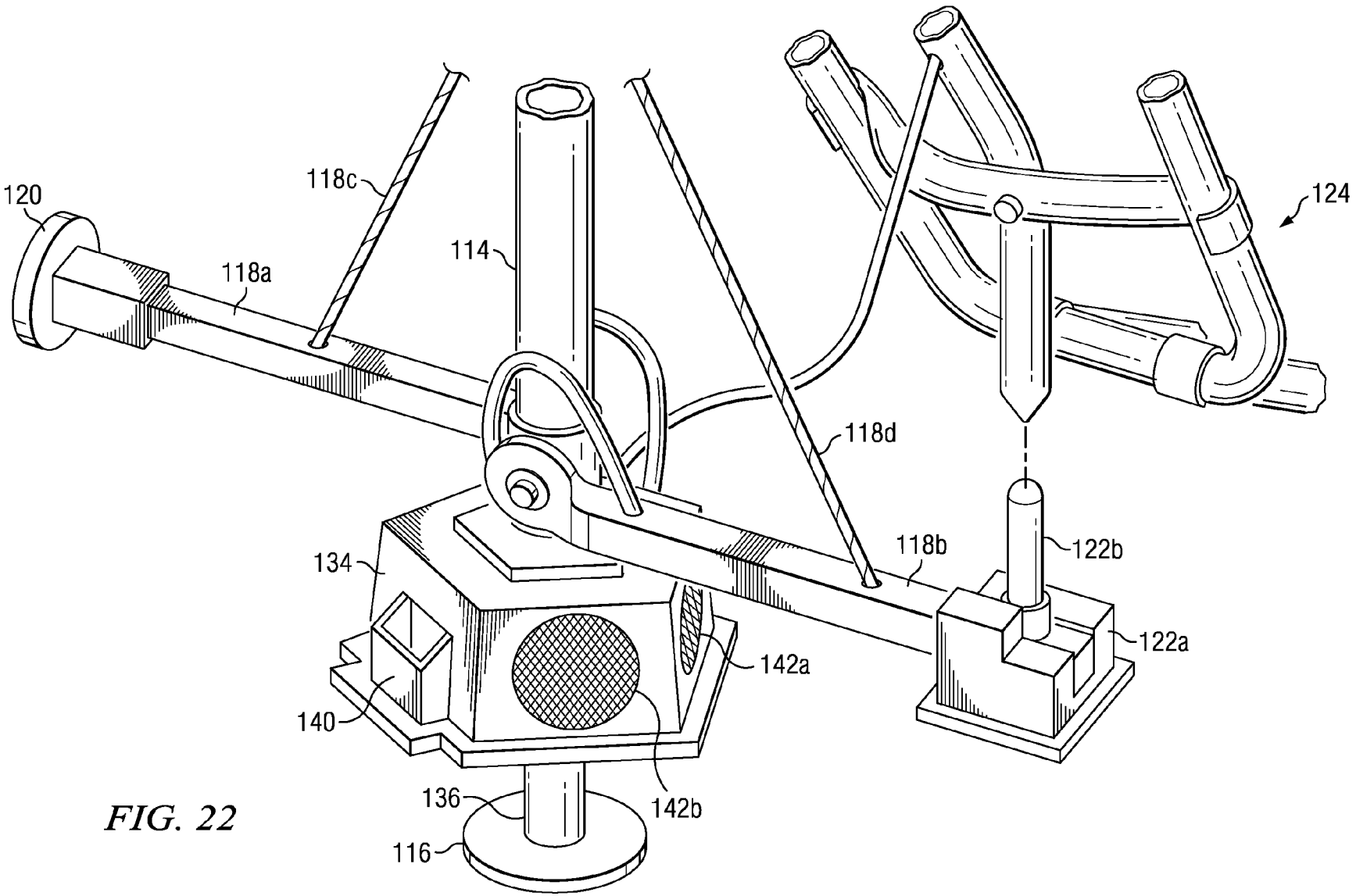
FIG. 22 is a perspective view of support structure and deflector according to one embodiment of the present disclosure.
Figure 24A:
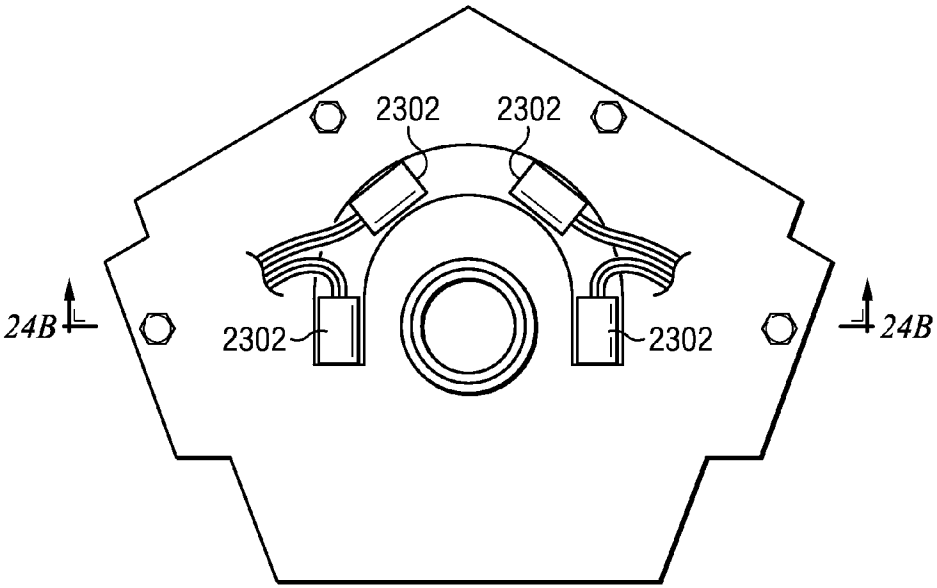
FIG. 24 is a sectional view of the electronic housing bottom lid according to one embodiment of the present disclosure.
Figure 24B:
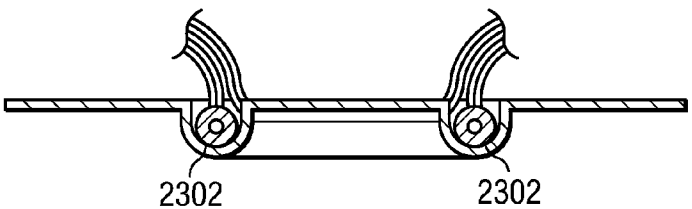
Figure 23:
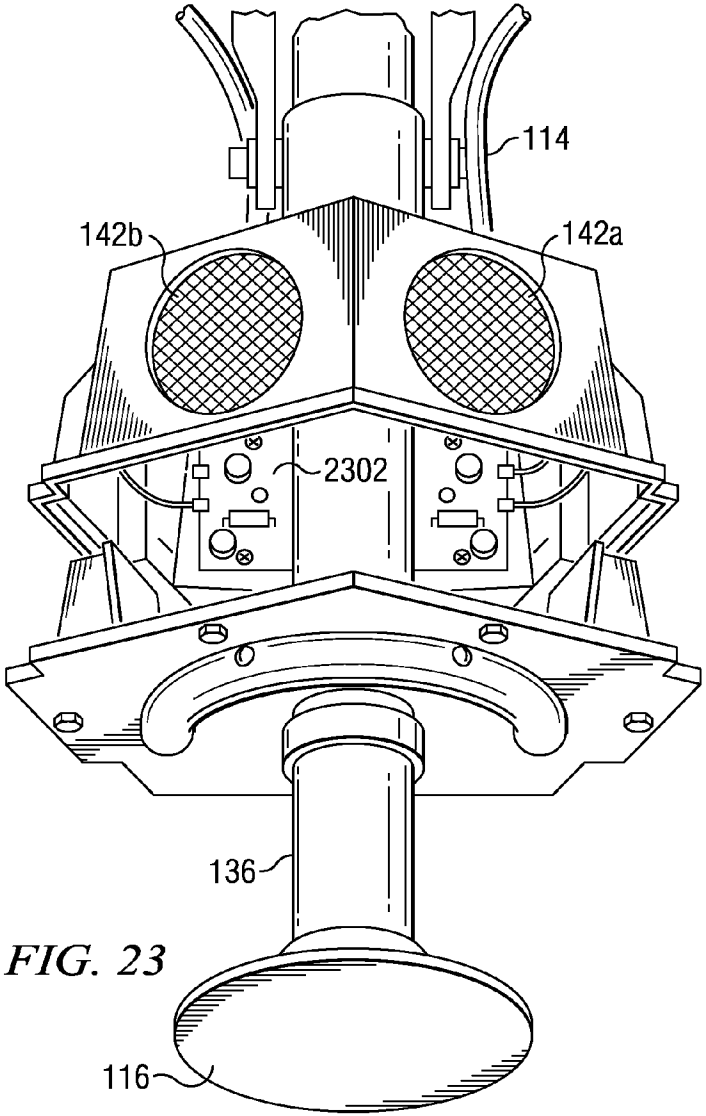
FIG. 23 is a perspective view of the electronic housing internal parts according to one embodiment of the present disclosure.
Figure 26:
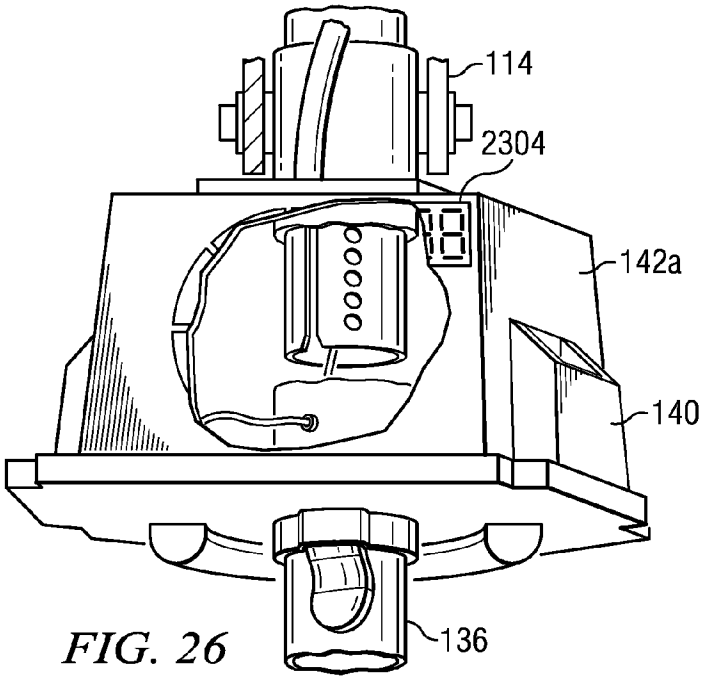
FIG. 26 is a perspective cutaway view of the hollow shaft assembly according to one embodiment of the present disclosure.
Figure 25:
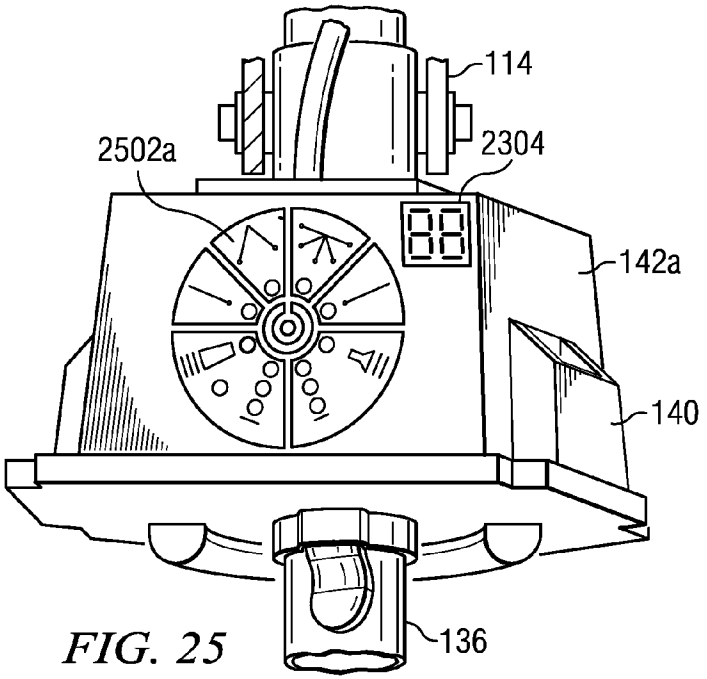
FIG. 25 is a perspective view the electronic housing control panel according to one embodiment of the present disclosure.

FIG. 15 is a perspective view of exemplary battery pack 1500 for use with, for example, power supply 120 shown in FIG. 1. It should be understood that battery pack 1500 shown in FIG. 15 is for illustrative purposes only and that any other suitable size, shape, or configuration of battery pack 1500 could be used in conjunction with or in lieu of battery pack 1500 shown in FIG. 15 according to one embodiment of the present disclosure.

Battery pack 1500 could be attached to a distal end of support 118*a*. Support 118*a* could include latching slots 1502 that removably connect with latches 1504 associated with battery pack 1500 and provide a secure connection between support 118*a* and battery pack 1500 according to one embodiment of the present disclosure.

FIGS. 18-21 illustrate various views of rotation module 122*a* and support 122*b* according to one embodiment of the present disclosure. It should be understood that rotation module 122*a* and support 122*b* shown in FIGS. 18-21 are for illustrative purposes only and that any other suitable size, shape, or configuration of rotation module 122*a* and support 122*b* could be used in conjunction with or in lieu of rotation module 122*a* and support 122*b* shown in FIGS. 18-21 according to one embodiment of the present disclosure.

Figure 33:
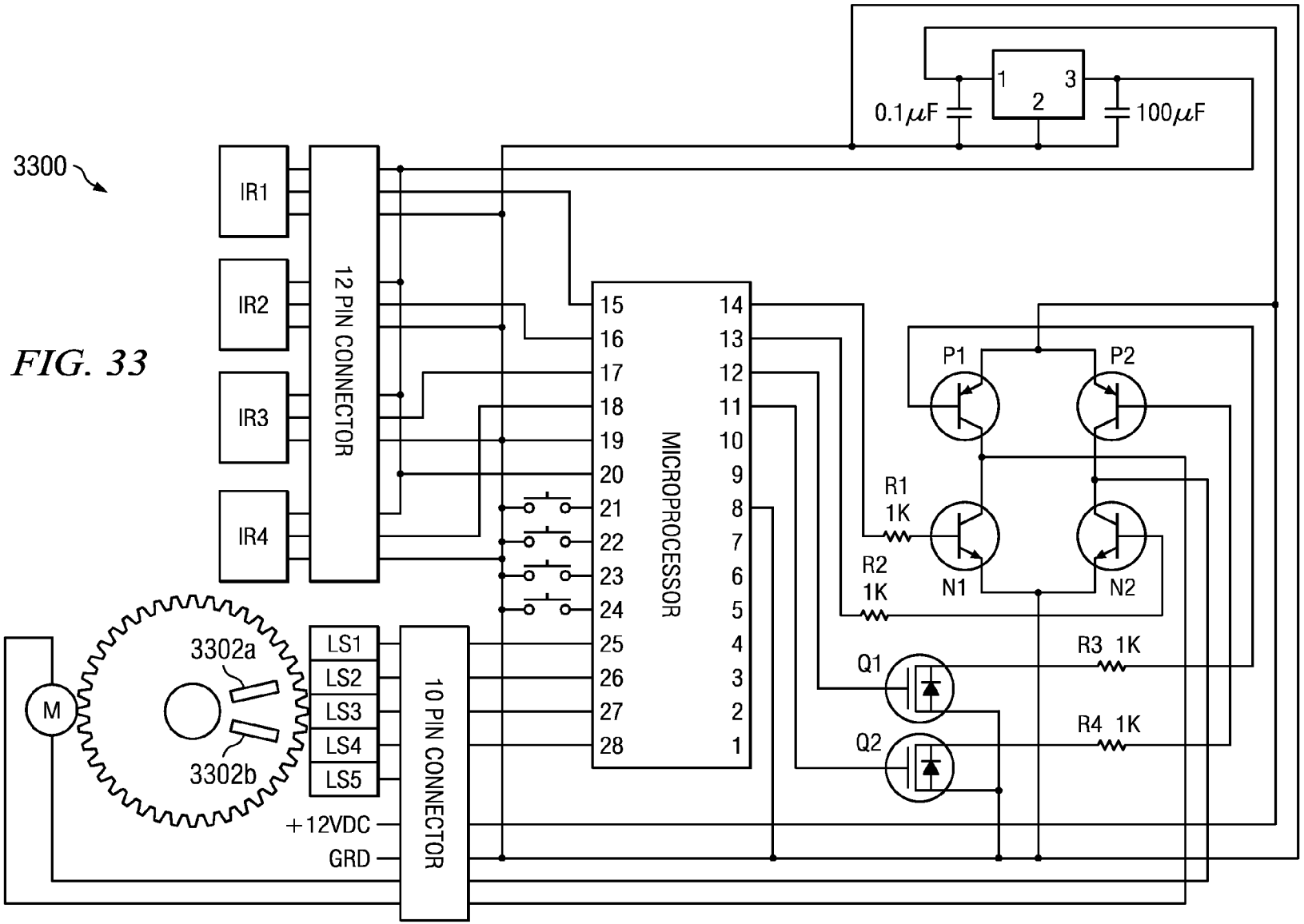
FIG. 33 is a somewhat simplified schematic of the IR turning circuit according to one embodiment of the present disclosure.

Generally, rotation module 122*a* rotates return device 124 as directed by system 100 and in particular an infrared sensor circuit 3300 later shown in and described in conjunction with the description accompanying FIG. 33. For example, as seen in FIG. 33, rotation module 122*a* could include motor 2002, gear train 2004, turning shaft 2006, position switches 2008, and actuator 2010.

FIGS. 22-26 illustrate various views of housing 134 according to one embodiment of the present disclosure. It should be understood that housing 134 shown in FIGS. 22-26 are for illustrative purposes only and that any other suitable size, shape, or configuration of housing 134 could be used in conjunction with or in lieu of housing 134 shown in FIGS. 22-26 according to one embodiment of the present disclosure.

Housing 134 could generally surround a lower portion of extension structure 114 and house one or more of processors 2302, display windows 2304 (shown in FIGS. 25 and 26), setting buttons 2502 (shown in FIG. 25), recorders, amplifiers, circuit boards, sensors, input and output jacks, switches, and speakers 142.

Figure 27B:
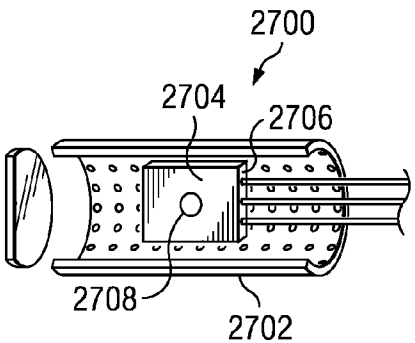
FIG. 27 is a perspective and a cutaway view of the IR unit according to one embodiment of the present disclosure.
Figure 27A:
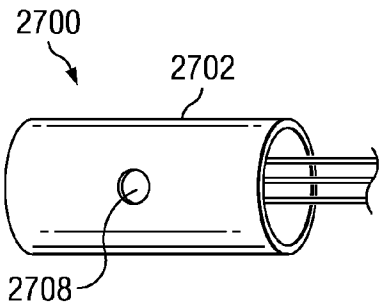

FIG. 27 is a perspective and a cutaway view of infrared (IR) unit 2700 according to one embodiment of the present disclosure. It should be understood that IR unit 2700 shown in FIG. 27 is for illustrative purposes only and that any other suitable size, shape, or configuration of IR unit 2700 could be used in conjunction with or in lieu of IR unit 2700 shown in FIG. 27 according to one embodiment of the present disclosure.

IR unit 2700 could include a casing, cover, or seal 2702 according to one embodiment of the present disclosure. For example, seal 2702 could include an opaque black colored silicon seal that prevent random IR signal from activating IR sensors in system 100 including IR sensor 2704. In one embodiment, IR sensor 2704 and lens 2706 could be kept aligned with portal opening 2708 using seal 2702 as shown in FIG. 27. It should be understood that any suitable configuration of sensor 2704, seal 2702, and lens 2706 could be used in accordance with the present disclosure.

Figure 28:
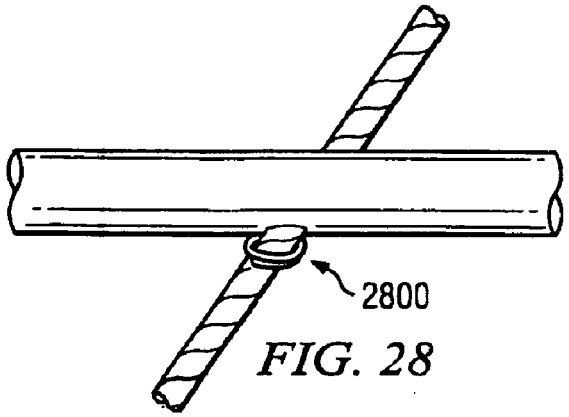
FIG. 28 is a perspective view of the rope-securing clamp according to one embodiment of the present disclosure.

FIG. 28 is a perspective view of rope-securing clamp 2800 according to one embodiment of the present disclosure. It should be understood that rope-securing clamp 2800 shown in FIG. 28 is for illustrative purposes only and that any other suitable size, shape, or configuration of rope-securing clamp 2800 could be used in conjunction with or in lieu of rope-securing clamp 2800 shown in FIG. 28 according to one embodiment of the present disclosure. Rope-securing clamp 2800 could aid in retaining supports 118*c* and 118*d* on supports 118*a* and 118*b*, respectively.

It is noted that FIG. 29 is generally discussed in conjunction with the description accompanying FIG. 1 above.

Figure 30:
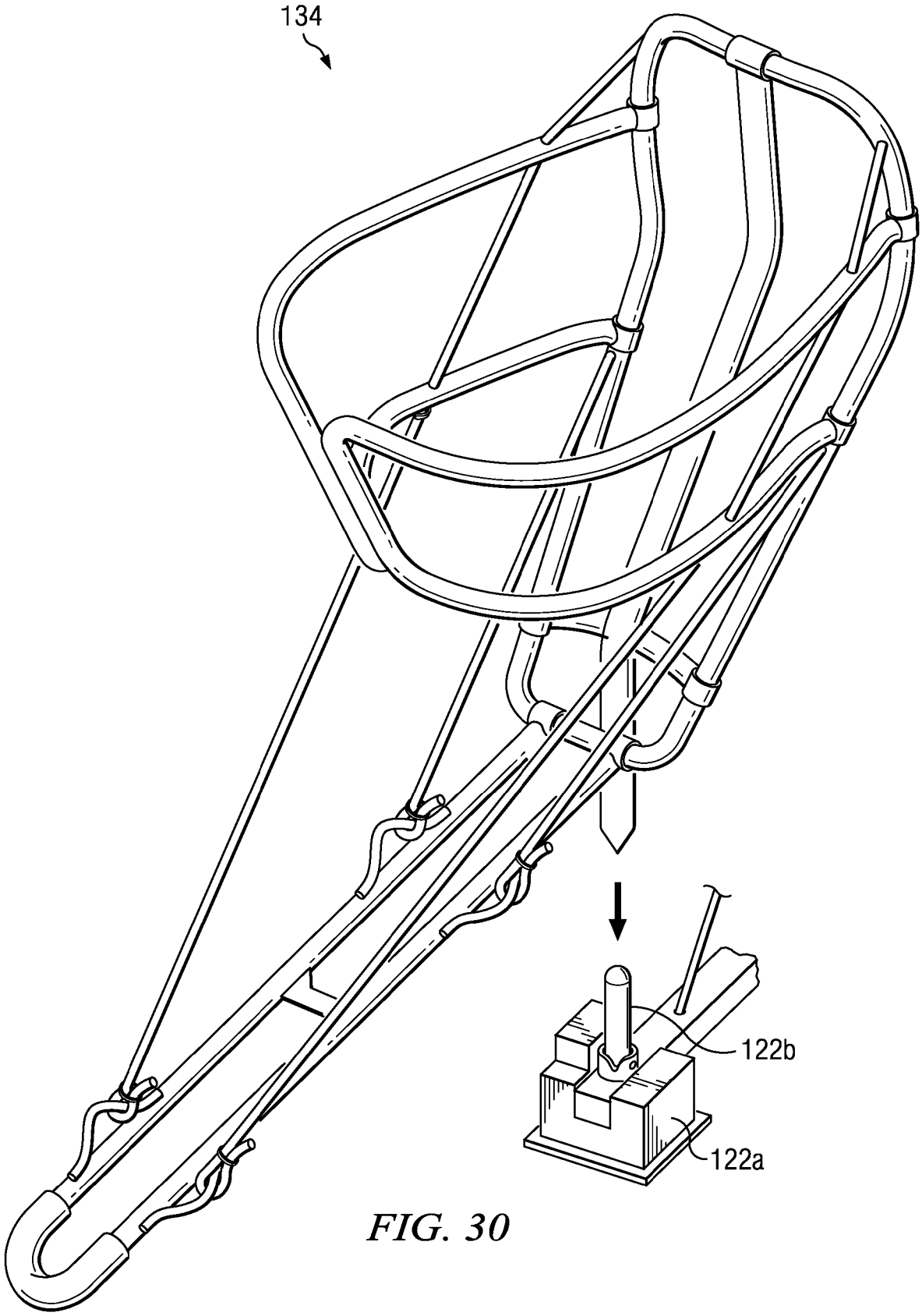
FIG. 30 is a perspective view the deflector assembly according to one embodiment of the present disclosure.

FIG. 30 is a perspective view 3000 illustrating a relative position and connection between return device 124 and rotation module 122*a* according to one embodiment of the present disclosure. It should be understood that view 3000 shown in FIG. 30 is for illustrative purposes only and that any other suitable size, shape, configuration, or relative positioning of return device 124 and rotation module 122*a* could be used in conjunction with or in lieu of return device 124 and rotation module 122*a* shown in FIG. 30 according to one embodiment of the present disclosure.

A proximate end of return device 124 is configurable to rotate about a vertical axis (e.g., a vertical axis associated with rotation module 122*a*) and face the shooter as he/she moves about the basketball court, substantially perpendicular to the floor without interfering with any hardware or portion of basketball goal 102 according to one embodiment of the present disclosure.

Figure 31:
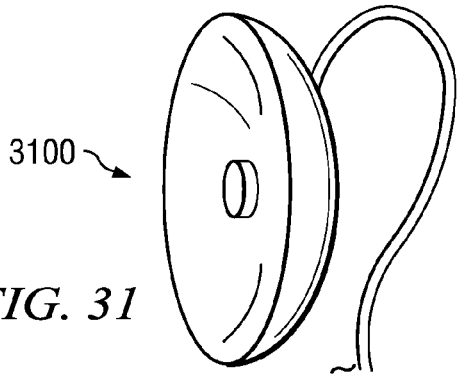
FIG. 31 is a perspective view of the IR transmitter according to one embodiment of the present disclosure.

FIG. 31 is a perspective view of IR transmitter 3100 according to one embodiment of the present disclosure. It should be understood that IR transmitter 3100 shown in FIG. 31 is for illustrative purposes only and that any other suitable system or subsystem could be used in conjunction with or in lieu of IR transmitter 3100 according to one embodiment of the present disclosure.

IR transmitter 3100 could include a remote transmitter or generator that transmits an infrared light beam, modulated light beam, or signal (sometimes collectively referred to herein as a "signal") receivable by, for example, system 100. For example, IR transmitter 3100 could send a signal, which when detected by one of several receivers in or associated with housing 134, determines the direction rotation module 122*a* should turn return device 124 and at what position system 100 should stop so that return device 124 is aligned with the shooter.

IR transmitter could be worn by the shooter either as an accessory or as part of another accessory. For example, IR transmitter 3100 could be attached, clipped, worn, or otherwise associated with shooter's clothing, shoes, headband, wristband, belt, shoes, socks, knee brace, elbow brace, ring, watch, jewelry, glasses, ear plug, headphones, head gear, cap, other suitable accessory or clothing piece, or any combination thereof. It should be understood that more than one shooter could be outfitted with different IR transmitters 3100 at any given time in order to practice in turn, sequentially, or in round-robin fashion.

In one embodiment, IR transmitter 3100 could be an IR receiver configured to receive a signal from system 100 shown in FIG. 1. In another embodiment, IR transmitter 3100 could be an IR transceiver configured to transmit and receive a signal from system 100. In yet another embodiment, IR transmitter could be an IR transceiver and storage device configured to transmit and receive a signal from system 100 and store or process any data regarding the position of the shooter.

Figure 32:
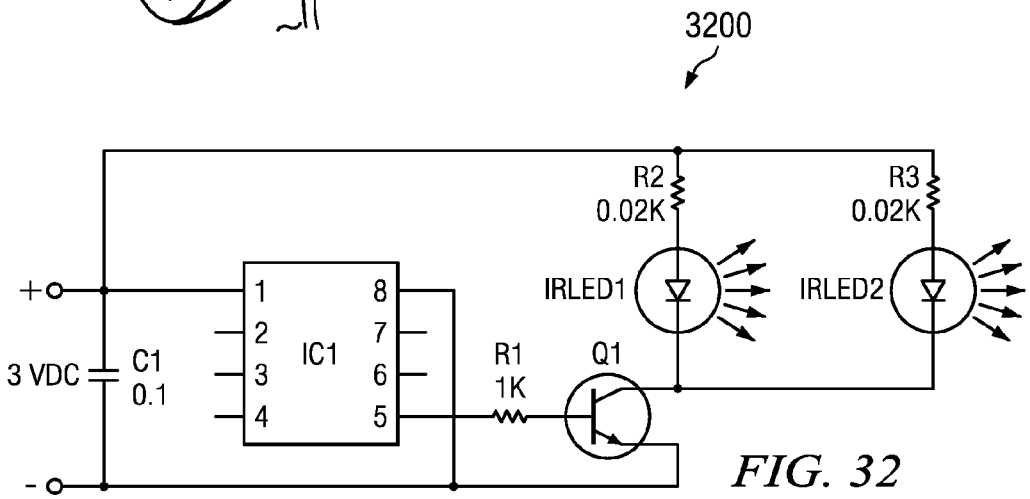
FIG. 32 is a somewhat simplified schematic of the IR transmitter according to one embodiment of the present disclosure.

FIG. 32 is a somewhat simplified schematic of IR transmitter 3100 shown in FIG. 31 according to one embodiment of the present disclosure. It should be understood that circuitry associated with IR transmitter 3100 shown in FIG. 32 is for illustrative purposes only and that any other suitable circuit could be used in conjunction with or in lieu of the circuit shown for IR transmitter 3100 according to one embodiment of the present disclosure.

IR transmitter 3100 could include an integrated circuit or chip having the necessary logic to allow for transmission of IR signals to system 100 according to one embodiment of the present disclosure. In one embodiment, IR transmitter 3100 could include one or more light emitting diodes to indicate the status of IR transmitter 3100 or any battery associated with IR transmitter 3100.

FIG. 33 is a somewhat simplified schematic of the IR turning circuit 3300 according to one embodiment of the present disclosure. It should be understood that circuitry associated with IR turning circuit 3300 shown in FIG. 33 is for illustrative purposes only and that any other suitable circuit could be used in conjunction with or in lieu of the circuit shown for IR turning circuit 3300 according to one embodiment of the present disclosure.

Although all features are not described herein for IR turning circuit 3300, it should be understood that IR1 through IR4 sensors are infrared signal receivers, which are activated by a modulating infrared signal (see FIG. 32). IR1 through IR4 sensors could be equally spaced in a one hundred and eighty degree arc inside the domed channel protrusion located on the underside of housing 134.

LS1 through LS4 position switches input to microcontroller 162 and could be equally spaced around the shaft of extendible structure 114 in a one hundred and eighty degree configuration. As the gear and shaft rotate, the attached actuator moves with the gear and shaft and, in turn, actuates LS1 through LS4 position switches.

Magnets 3302*a* and 3302*b* shown in FIG. 33 close together causes two of the switches LS1-LS4 to actuate at the same time giving an additional position between each switch. These switch combinations provide the microprocessor with the necessary information. The microprocessor, in turn, could determine the real time position of the gear and shaft as they rotate.

As an example, when a modulating infrared transmitting device attached to the shooter moves, one or both of the two IR1 through IR4 sensors 144 receives the signal and provides the corresponding input to the microprocessor and gives the next position towards which the shaft (and thus return device 124) should turn.

Figure 34A:
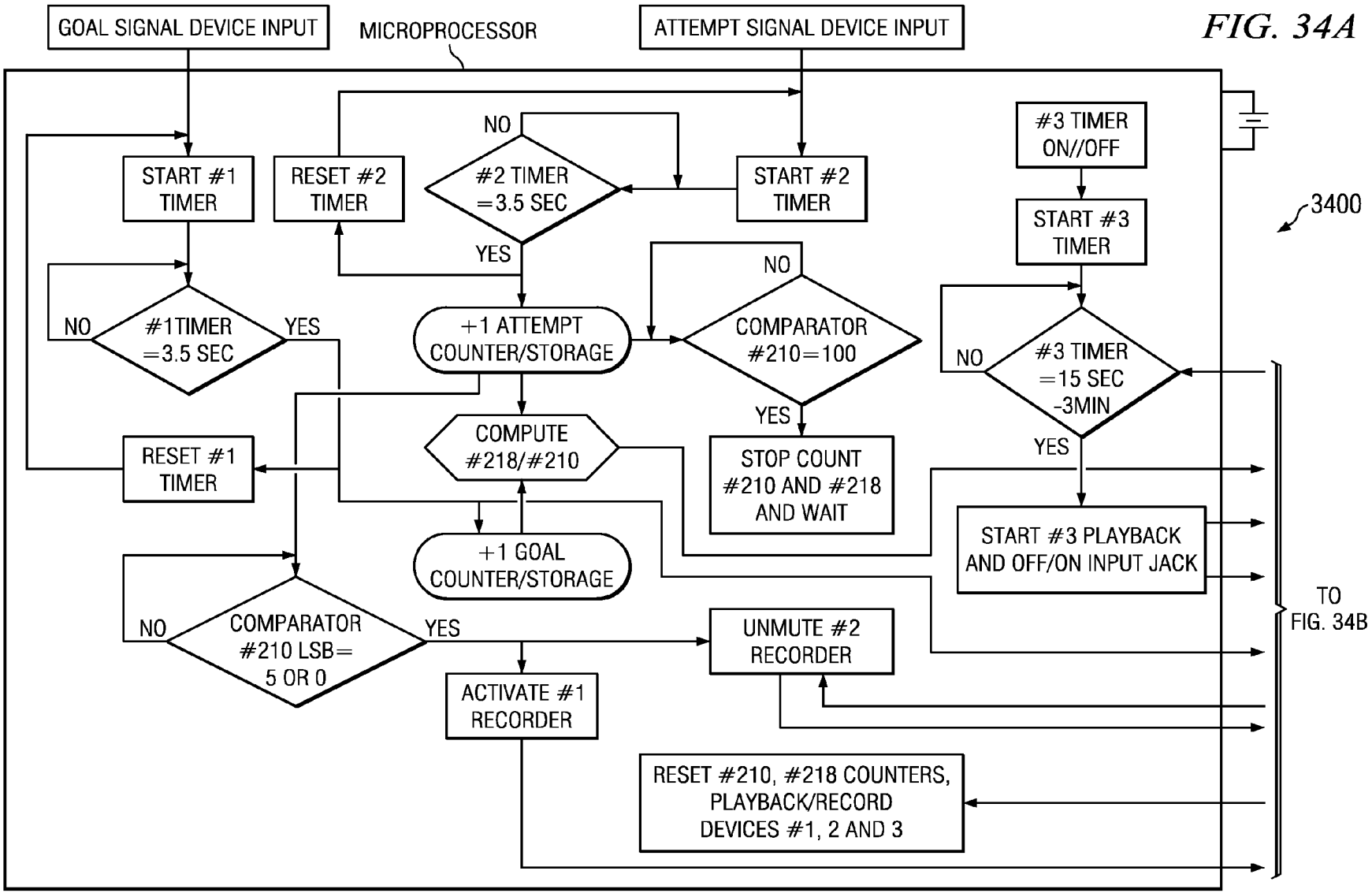
FIG. 34 is a somewhat simplified flow diagram of the remaining circuits according to one embodiment of the present disclosure.
Figure 34B:
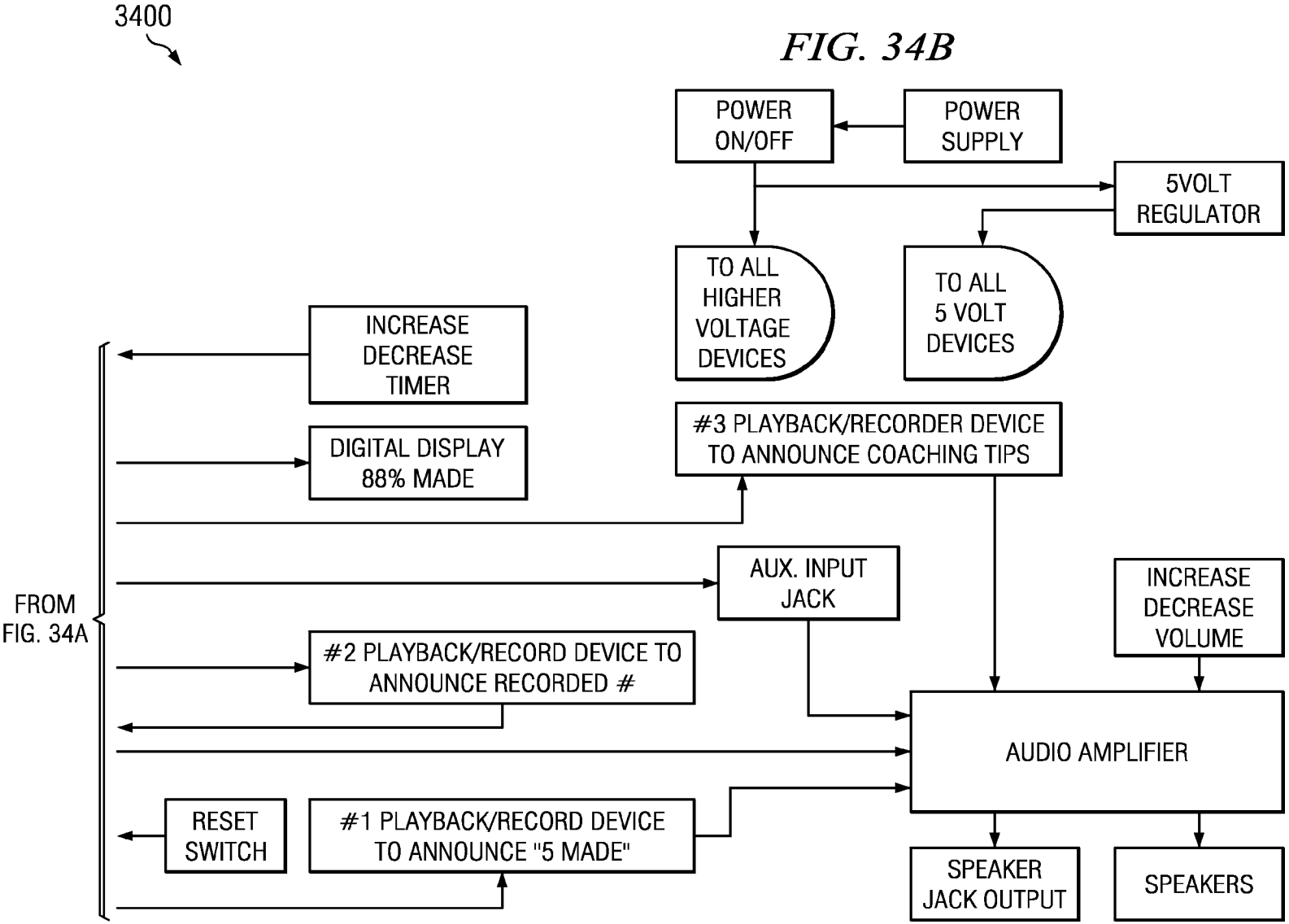

FIG. 34 is a somewhat simplified flow diagram 3400 of the remaining circuits of system 100 according to one embodiment of the present disclosure. It should be understood that processes shown in FIG. 34 are for illustrative purposes only and that any other suitable process could be used in conjunction with or in lieu of flow diagram 3400 according to one embodiment of the present disclosure.

Flow diagram 3400 generally includes a process diagram outlining how power is distributed by power supply 120. For example, a voltage regulator could be used to supply power to lower voltage devices. Flow diagram 340 also outlines what occurs when a signal is returned from basketball goal 102. For example, a timer could set to monitor activities for a predetermined amount of time. In addition, flow diagram 3400 could include a process for announcing coaching tips and announcing goals at certain intervals.

Figure 35:
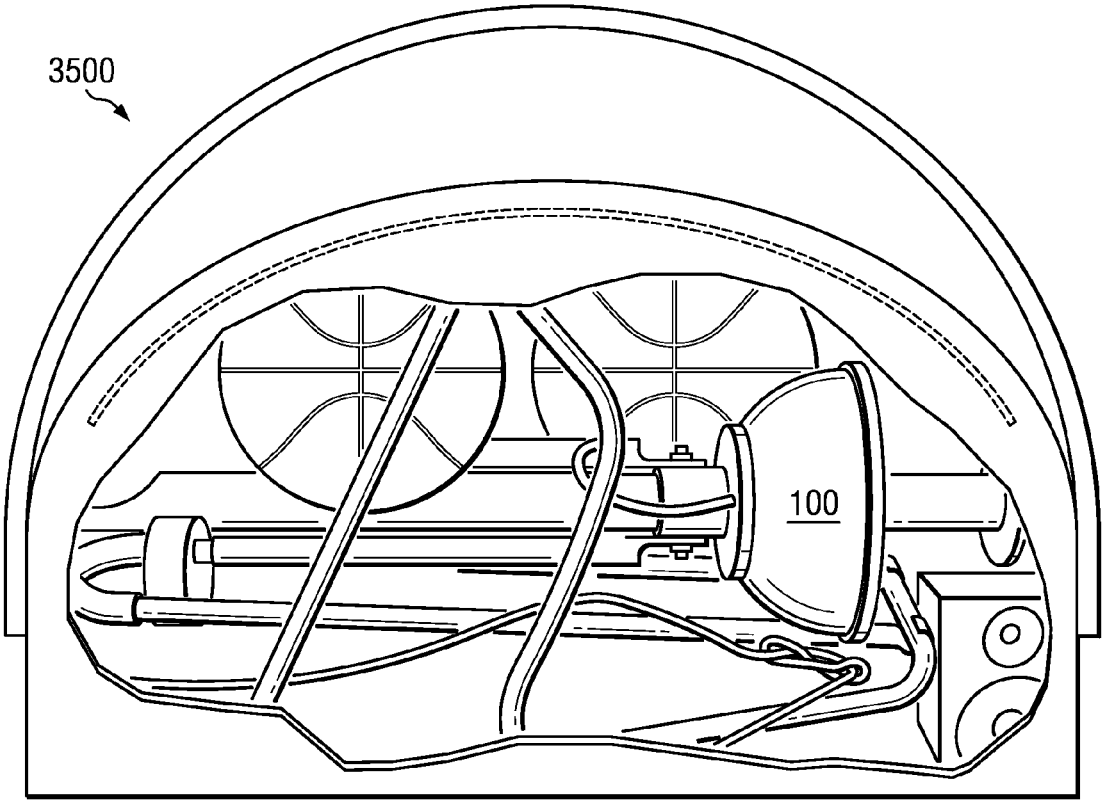
FIG. 35 is a perspective cutaway view of the carrying bag according to one embodiment of the present disclosure.

FIG. 35 is an illustration of storage bag 3500 for use with system 100 according to one embodiment of the present disclosure. It should be understood that storage bag 3500 shown in FIG. 35 is for illustrative purposes only and that any other suitable system or subsystem could be used in conjunction with or in lieu of storage bag 3500 according to one embodiment of the present disclosure.

In one embodiment, storage bag 3500 could accommodate, for example, system 100 as well as two basketballs and a speaker for surround sound. System 100 could be removed from bag 3500 and anchoring system 112 be swiveled from its transportable position to its operational position.

Storage bag 3500 could include a material similar to standard athletic bags and be of a color suitable to the user or organization according to one embodiment of the present disclosure. In one embodiment, storage bag 250 could have an option of a speaker imbedded in it and connected by wire, or be wireless, to the audio amplifier inside housing 134 as a personal playback device. An insulated compartment for cold compresses plus other items applicable to athlete's cold or hot needs could be incorporated into storage bag 3500 according to one embodiment of the present disclosure.

Figure 36A:
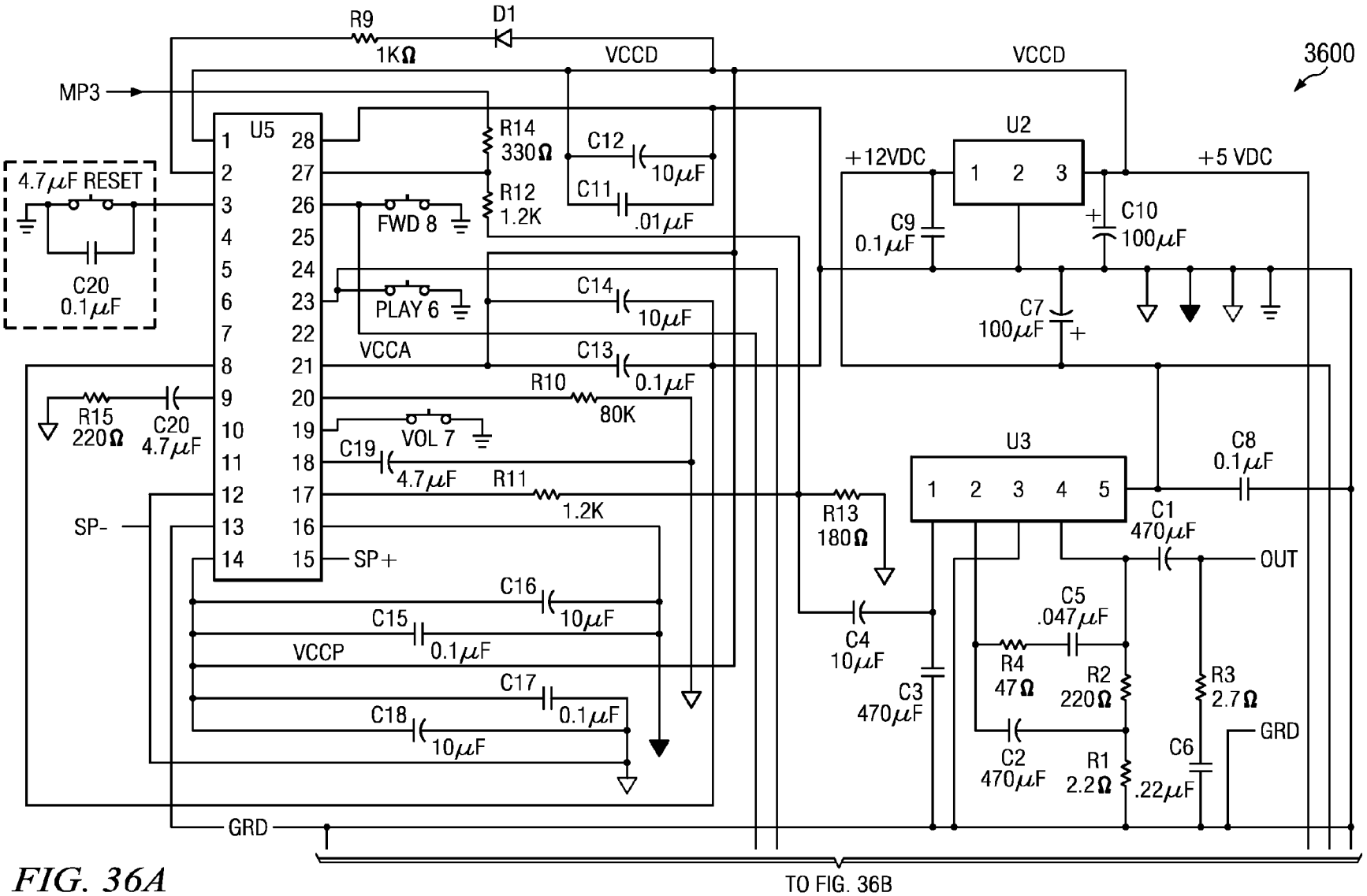
FIG. 36 is a somewhat simplified schematic of the main circuit board according to one embodiment of the present disclosure.
Figure 36B:
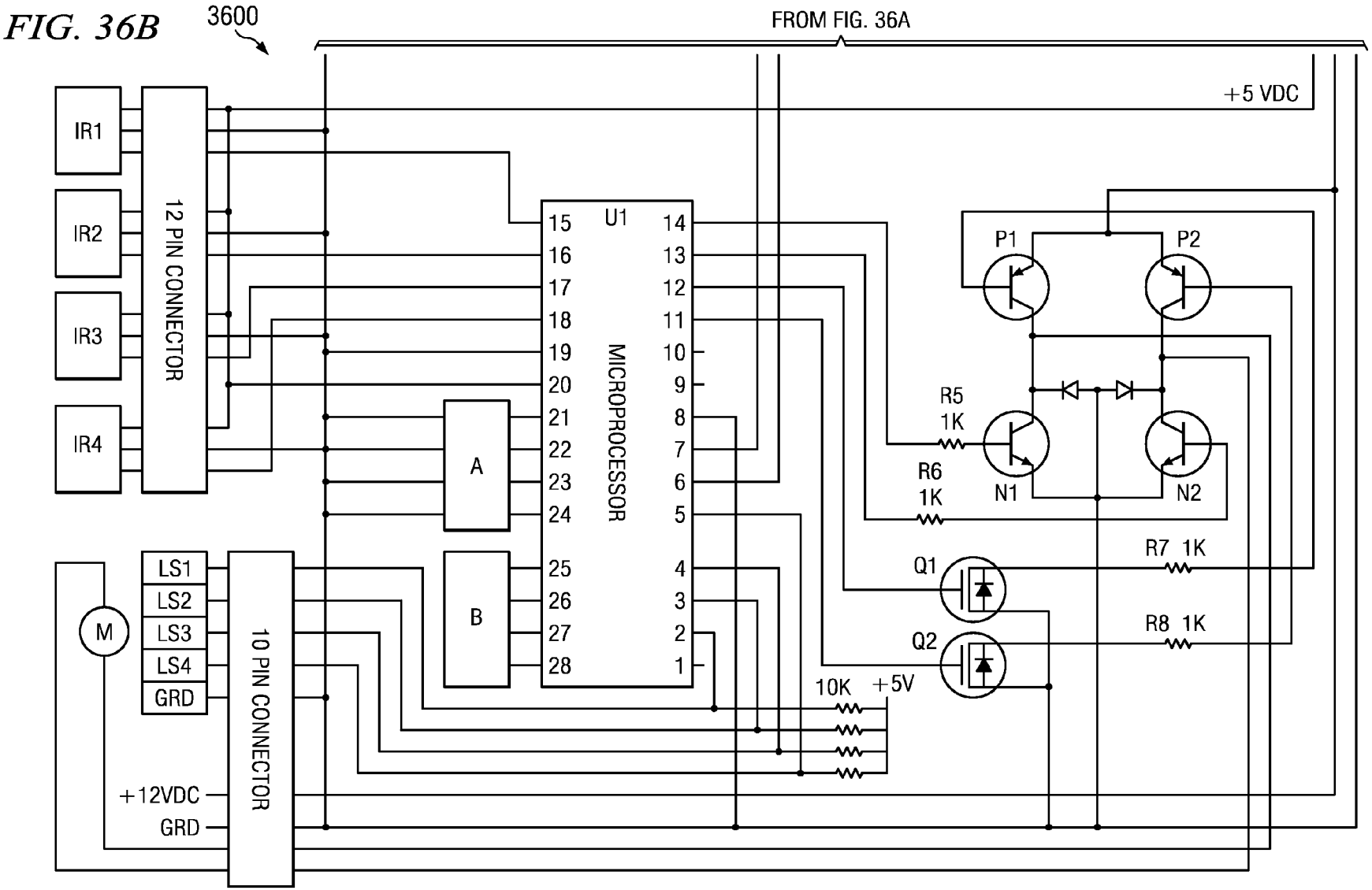

FIG. 36 is a somewhat simplified schematic of exemplary circuit board 3600 of system 100 according to one embodiment of the present disclosure. It should be understood that circuit board 3600 shown in FIG. 36 is for illustrative purposes only and that any other suitable system or subsystem could be used in conjunction with or in lieu of circuit board 3600 according to one embodiment of the present disclosure.

As shown in FIG. 36, system 100 could operate in a number of different modes according to one embodiment of the present disclosure. In an exemplary mode #1, the motor could turn in the direction of the transmitter and stop at that position and waits for a new signal. If a new signal is not received within 5 seconds or so, the processor will turn the motor to the next position according to one embodiment of the present disclosure.

In exemplary mode #2, the motor could turn to position #3, wait four or so seconds then turns to position #5, wait four or so seconds then returns back to position #3 according to one embodiment of the present disclosure. In one embodiment, this could repeat until power is discontinued or a new mode is selected.

In exemplary mode #3, the motor could turns to position #2, wait four seconds or so then turns to position #4, wait four seconds or so than turns to position #6, wait four seconds or so and turns back to position #4, wait four seconds or so then turns to position #2 according to one embodiment of the present disclosure. In one embodiment, this process could repeat until power is discontinued or a new mode is selected.

In exemplary mode #4, the motor could turn only when an IR signal is received by the IR receiver according to one embodiment of the present disclosure.

Figure 37A:
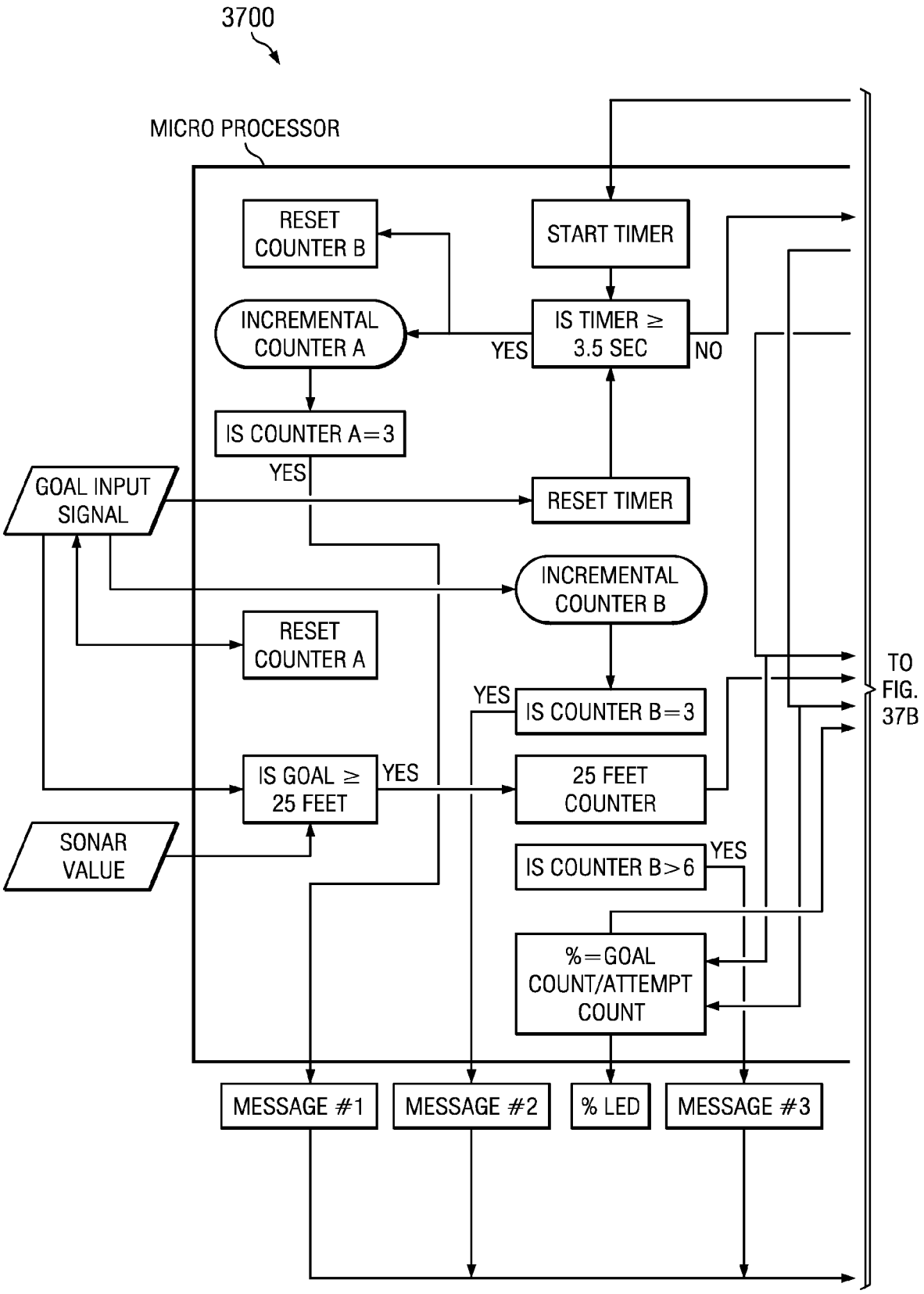
FIG. 37 is a somewhat simplified flow diagram for added features for the system according to one embodiment of the present disclosure.
Figure 37B:
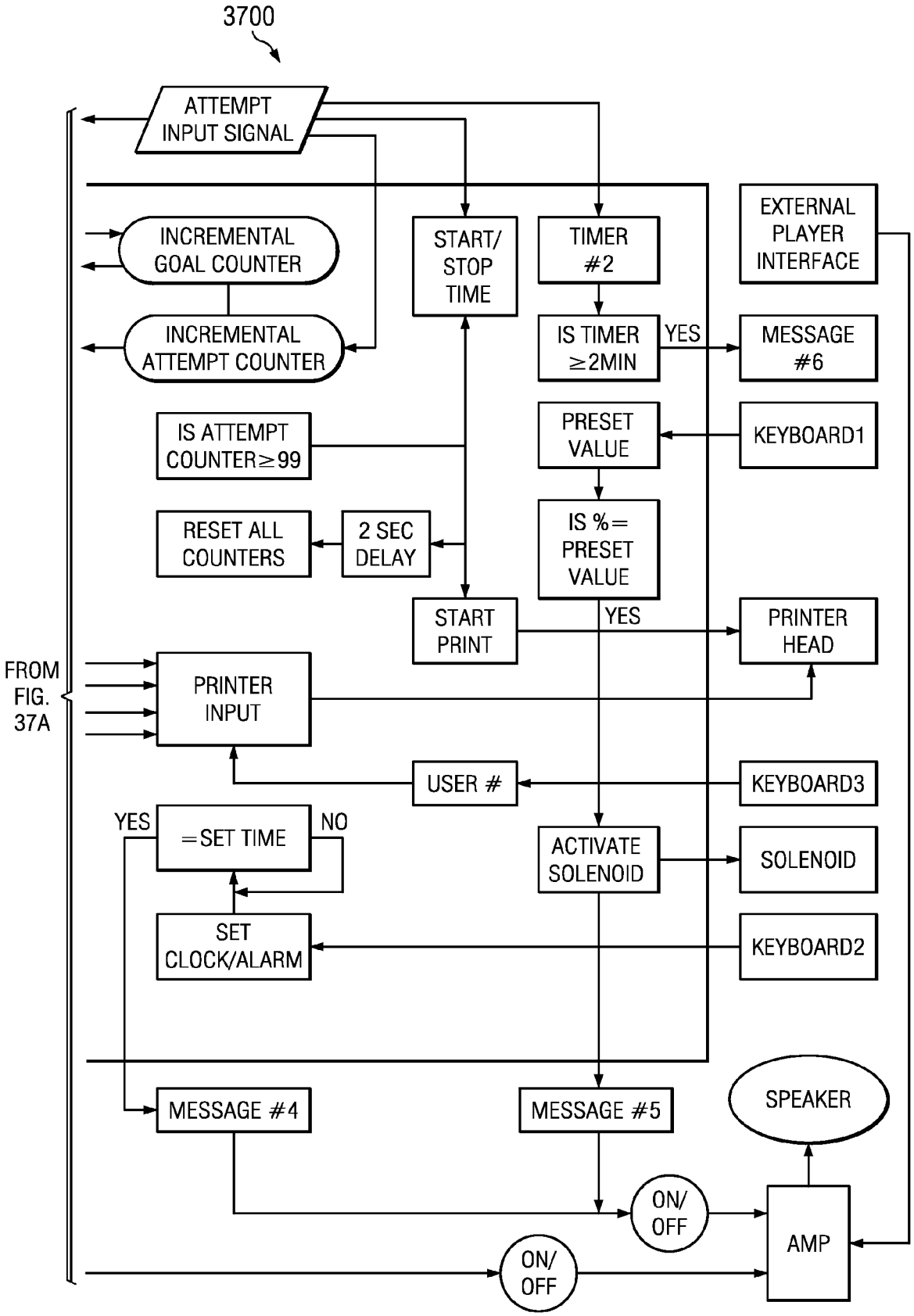

FIG. 37 is a somewhat simplified flow diagram 3700 of certain features of system 100 according to one embodiment of the present disclosure. It should be understood that flow diagram 3700 shown in FIG. 37 is for illustrative purposes only and that any other suitable system or subsystem could be used in conjunction with or in lieu of flow diagram 3700 according to one embodiment of the present disclosure.

Flow diagram 3700 generally illustrates certain processes for system 100. For example, flow diagram 3700 could include a process for using certain inputs such as, for example, keyboards, sensor (or sonar) inputs, goal inputs, attempt input signals, external player interfaces, and other suitable inputs. Flow diagram 3700 also illustrates a number of possible outputs such as, for example, messages, printable items, speakers, LEDs, displays, and other suitable outputs.

In one embodiment, sonar inputs could include inputs from return device 124 that indicate the distance between return device 124 and where the shooter is positioned. Accordingly, system 100 could ascertain whether the shooter has attempted and made, for example, a three-point shot. For example, if the sonar value indicates that the shot was made 25 feet or more from basketball goal 102, then system 100 could record the shot as a "3-point" shot according to one embodiment of the present disclosure. It should be understood that any such distance measurement could be customized by the user of system 100 or kept at predetermined value correlations.

In one embodiment, a solenoid could be used to reward the shoot or provide some other form of feedback. For example, if a predetermined number of goals is met by the shooter, the solenoid could be activated to give the shooter a prize or any other suitable object as a reward or as feedback on training principles according to one embodiment of the present disclosure.

As an example, flow diagram 3700 illustrates a process in which system 100 could give various messages and rewards to the user for different levels of performance. Input by the user, parent or coach could be provided by pushing buttons (keyboard) on the control panel to set up goals to be met, alarms for when to start practice, and user ID numbers. The Attempt Input signal comes from shock sensors 1200 and the Goal Input signal comes from a sensor on return device 124 according to one embodiment of the present disclosure. Both could be actuated by the impact of a basketball. Messages provided by system 100 could be prerecorded and match the degree of performance of the user and triggered by the following events—The messages could ultimately be on just one addressable recorder:

In one embodiment, the Attempt Input Signal inputs to the Start Timer, timer #2, Incremental Attempt Counter, and Start/Stop clock. The Start Timer waits 3.5 seconds for a Goal Input Signal. If it gets the Goal Input Signal within the 3.5 seconds, one count registers on the Incremental Goal Counter. On the other hand, if there is no Goal Input Signal within the 3.5 seconds, one count registers on the Incremental Counter A. When Counter A is equal to three, it triggers Message #1. The Incremental Counter A and the Start Timer reset to zero when a Goal Input Signal registers. The Goal Input Signal also causes Incremental Counter B to increase. When it reaches three, it triggers Message #2. When Incremental Counter B reaches more than six, it triggers Message #3. Incremental Counter B resets to zero with a signal from the Yes side of the timer. Each time there is an increase in either the Goal or Attempt Incremental Counters, division takes place between the two numbers and the quotient displays on a LED. A Preset Value (quotient) can be set and when reached, a solenoid activates and message #5 plays. When the Incremental Attempt Counter reaches ninety-nine, it resets to zero and prints out the user ID number, the start time, the finish time, the number of Attempts, the number of goals, the quotient (%) and the number of 3 point goals. An optional real time clock can be set for a start time, a finish time, and a message for both plays. If there is no Attempt Input Signal to Reset Timer #2 within 2 minutes, message #6 plays. Buttons similar to the mode buttons facilitate inputting settings and would be located in proximity to the other buttons.

An object of the present disclosure is to provide a basketball return and coaching device for practicing basketball players to maximize the number of shots attainable by returning successfully shot basketballs back to their position accurately anywhere on the court and announcing their scoring results along with coaching statements by means of speakers and associated electronics.

Another object is to provide a basketball return and coaching device that senses the location of a practicing shooter on a basketball court and automatically turns towards their position and accurately returns successfully shot basketballs (goes through the rim and net) back to where the shooter moves on the court.

Another object is to provide a basketball return and coaching device that will make shooting practice pleasant by allowing the shooter to play their individual playback device to keep them entertained while practicing. Another object is to provide a basketball return and coaching device that will encourage young people to enjoy practicing by making practicing fun and exciting with features like a robot instructing them with coaching advice.

Another object is to provide a basketball return and coaching device that can be easily and quickly installed and uninstalled from the ground even by a height challenged person without the need of tools or ladder. Another object is to provide a basketball return and coaching device that when installed does not interfere with the normal function of basketball goals currently in use and automatically adjusts too many different styles of rim brackets.

Another object is to provide a basketball return and coaching device that will track the number of shoots attempted and missed and announce the results so the user can know their performance as they are shooting. Another object is to provide a basketball return and coaching device that is battery operated, light and very transportable so the user can easily travel to any court inside or out and quickly, within ten seconds, install it and immediately start using it. Another object is to provide a basketball return and coaching device that has several training drills to choose from so the user can increase their skill level in maneuvering on the court while shooting from multiple positions.

Another object is to provide a basketball return and coaching device that computes shooting percentages of user, audibly acknowledges levels of performance, compares results to a predetermined percentage and gives a material reward to encourage increasingly good performance. Another object is to provide a basketball return and coaching device that can track and print a report as to the performance of the user, helping coaches to evaluate their players. Another object is to provide a basketball return and coaching device that reminds and encourages the user to practice their shooting skills.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A training system for use with a basketball goal having a rim bracket, a post, and a backboard, comprising:

an anchoring system releasably coupled to an upper portion of the rim bracket for supporting the training system beneath the basketball goal, the anchoring system having multiple segments coupled in a sliding arrangement held in tension, the segments configured to automatically adjust to the size of the rim bracket when placed in an operational position;

an elongated return apparatus having a distal end associated with a basketball goal and a proximate end to direct a ball passing through the basketball goal to a ball thrower; and a motorized apparatus secured to the proximate end of the return apparatus, the motorized apparatus being configured to rotate the elongated return apparatus and wherein the motorized apparatus includes a receiver to receive a signal transmitted from a transmitter.

2. The system of claim 1, wherein the transmitter is a transceiver configured to transmit and receive the signal from the training system.

3. The system of claim 1, wherein the transmitter is a storage device configured to store and process data regarding the position of the ball thrower.

4. The system of claim 1, wherein the motorized apparatus rotates the return apparatus in the direction of the user.

5. The system of claim 1 further comprising:

a circuit to record the number of goals achieved by the ball thrower.

6. The system of claim 1 further comprising:

a circuit to correlate statistics about the ball thrower.

7. The system of claim 1 further comprising:

an anchor secured to a rim bracket of the goal, wherein the anchor supports the return apparatus and the motor apparatus.

8. The system of claim 7, wherein the anchor comprises an extendible body disposed between the rim bracket and the motorized apparatus.

9. The system of claim 1 further comprising:

an extendible body disposed between the goal and a support structure associated with a power source, the motorized apparatus, and the return apparatus.

10. The system of claim 1, further comprising:

an imaging device for capturing movements and images of the training system and the ball thrower.

11. A training system for a basketball goal having a rim bracket, a post, and a backboard, comprising:

an anchoring system releasably coupled to an upper portion of the rim bracket for supporting the training system beneath the basketball goal, the anchoring system having: multiple segments;

a plurality of segments coupled in a sliding arrangement held in tension, the segments configured to automatically slide apart so as to accept the rim bracket when placed in an operational position;

a tension member coupled to each segment for applying a resistive force on the segments, the resistive force configured to resist motion; and a protruding structure coupled to at least one segment, the protruding structure and the tension member being configured to resist movement of the training system when the anchoring system is lowered into the operational position;

an elongated return apparatus having a distal end associated with a goal and a proximate end to direct a ball passing through the goal to a ball thrower;

a transmitter to generate a signal having information related to the user, the transmitter located remote to the basketball goal, a motorized apparatus rotatably coupled to the elongated return apparatus so as to direct the direction of the elongated return apparatus;

a circuit operably coupled to the training system for processing, gathering, communicating, and compiling information.

12. The system of claim 11, correlate statistics based on user performance.

13. The system of claim 11, wherein the anchoring system has a shock sensor to absorb vibrations from the rim bracket.

14. The system of claim 11, wherein the training system is configured to nestle together in a compact transportable position such that the training system can be accommodated in a single bag.

15. A method of using the training system of claim 1 or claim 11, comprising the steps of:

obtaining a training system having an anchoring system and a support system, the anchoring system having a plurality of segments coupled in a sliding arrangement relative to each other so as to automatically slide apart when located on the rim bracket, the segments applying a tension force to the rim bracket;

adjusting the training system into an operational position;

grasping the training system;

lifting the training system such that the anchoring system contacts the rim bracket, the training system secured to the rim bracket by interference fit generated by the tension force between the segments; and selecting a programmable mode using a setting button located on a housing coupled to the support system.

16. The method of using the training system of claim 15, further comprising the step of:

coupling a transmitter to a user; and moving the transmitter around the court, the motorized apparatus positioning an elongated return apparatus in relation to the location of the transmitter.

17. The method of using the training system of claim 15, further comprising the step of:

connecting a device to a music input.

18. The method of using the training system of claim 15, further comprising the step of:

downloading statistical information.

19. The method of using the training system of claim 15, further comprising the step of:

reviewing in real-time at least one of images, information, recordings, and data collected by the training system.

* * * * *